US011554280B2

(12) United States Patent
Hulbert et al.

(10) Patent No.: US 11,554,280 B2
(45) **Date of Patent: *Jan. 17, 2023**

(54) LONG-TERM FIRE RETARDANT WITH CORROSION INHIBITORS AND METHODS FOR MAKING AND USING SAME

(71) Applicant: FRS Group, LLC, Carnelian Bay, CA (US)

(72) Inventors: Dennis Hulbert, Grass Valley, CA (US); Robert J. Burnham, Incline Village, NV (US); Michael S. Schnarr, Sonora, CA (US); Gerald Geissler, Roseville, CA (US); David W. Wilkening, Ronan, MT (US); Joseph McLellan, Rocklin, CA (US)

(73) Assignee: FRS Group, LLC, Carnelian Bay, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/531,295

(22) Filed: Nov. 19, 2021

(65) Prior Publication Data

US 2022/0080242 A1 Mar. 17, 2022

Related U.S. Application Data

(63) Continuation of application No. 17/214,266, filed on Mar. 26, 2021, which is a continuation-in-part of (Continued)

(51) Int. Cl.
*A62D 1/00* (2006.01)
*A62C 3/02* (2006.01)

(52) U.S. Cl.
CPC ..... *A62D 1/0028* (2013.01); *A62C 3/0228* (2013.01); *A62D 1/0042* (2013.01)

(58) Field of Classification Search
CPC ..... A62D 1/0042
See application file for complete search history.

(56) References Cited

U.S. PATENT DOCUMENTS 2,759,924 A 8/1956 Touey
2,990,233 A 6/1961 Eugene et al.
(Continued)

FOREIGN PATENT DOCUMENTS

AU 2018435573 A1 3/2021
CA 2494914 C 1/2013
(Continued)

OTHER PUBLICATIONS

Àgueda Costafreda, Effects of long-term forest fire retardants on fire intensity, heat of combustion of the fuel and flame emissivity. Universitat Politècnica de Catalunya, 2009. 239 pages.
(Continued)

*Primary Examiner* — Peter F Godenschwager
(74) *Attorney, Agent, or Firm* — Smith Baluch LLP

(57) ABSTRACT

A forest fire retardant composition contains a retardant compound that includes a halide salt, a non-halide salt, a metal oxide, a metal hydroxide, or combinations thereof. The forest fire retardant composition may include at least one anhydrous salt and at least one hydrate salt. The halide salt may be magnesium chloride, calcium chloride, or both. The magnesium chloride hydrate has a formula $MgCl_2(H_2O)_x$, wherein x is at least one of x=1, 2, 4, 6, 8, or 12. The calcium chloride hydrate has a formula $CaCl_2(H_2O)_x$, wherein x is at least one of 1, 2, 4, or 6. The composition may be in the form of a dry concentrate, a liquid concentrate, or a final diluted product. The final diluted product is effective in suppressing, retarding, and controlling forest fires while exhibiting corrosion resistance and low toxicity.

16 Claims, 17 Drawing Sheets

Related U.S. Application Data application No. 16/894,214, filed on Jun. 5, 2020, now Pat. No. 10,960,249, which is a continuation of application No. PCT/US2020/036360, filed on Jun. 5, 2020.

(60) Provisional application No. 63/024,040, filed on May 13, 2020, provisional application No. 62/989,350, filed on Mar. 13, 2020, provisional application No. 62/858,640, filed on Jun. 7, 2019.

(56) References Cited

U.S. PATENT DOCUMENTS

| | | | |
|---|---|---|---|
| 3,342,749 | A | 9/1967 | Handleman et al. |
| 3,382,186 | A | 5/1968 | Silverstein |
| 3,409,550 | A | 11/1968 | Gould |
| 3,585,135 | A | 6/1971 | Smith et al. |
| 3,843,525 | A | 10/1974 | Hattori et al. |
| 4,134,876 | A | 1/1979 | Horner et al. |
| 4,134,959 | A | 1/1979 | Menke et al. |
| 4,145,296 | A | 3/1979 | Fox et al. |
| 4,168,239 | A | 9/1979 | Mertz et al. |
| 4,343,854 | A | 8/1982 | Moorman |
| 4,374,171 | A | 2/1983 | McCarter |
| 4,392,994 | A | 7/1983 | Wagener |
| 4,770,794 | A | 9/1988 | Cundasawmy et al. |
| 4,950,410 | A | 8/1990 | Pennartz |
| 4,983,326 | A | 1/1991 | Vandersall |
| 5,009,710 | A | 4/1991 | Bewsey |
| 5,596,029 | A | 1/1997 | Goebelbecker et al. |
| 5,849,210 | A | 12/1998 | Pascente et al. |
| 5,985,013 | A | 11/1999 | Kofler et al. |
| 6,019,176 | A | 2/2000 | Crouch |
| 6,162,375 | A | 12/2000 | Crouch et al. |
| 6,296,781 | B1 | 10/2001 | Amiran |
| 6,447,697 | B1 | 9/2002 | Vandersall |
| 6,517,747 | B2 | 2/2003 | Vandersall |
| 6,802,994 | B1 | 10/2004 | Kegeler et al. |
| 6,858,567 | B2 | 2/2005 | Akao |
| 7,115,677 | B2 | 10/2006 | Harashina et al. |
| 7,794,688 | B2 | 9/2010 | Caine et al. |
| 8,212,073 | B2 | 7/2012 | Kasowski |
| 8,871,058 | B2 | 10/2014 | Sealey et al. |
| 9,919,174 | B2 | 3/2018 | Vellmar |
| 9,982,195 | B2 | 5/2018 | Matsui |
| 10,550,483 | B2 | 2/2020 | Khosla et al. |
| 10,590,257 | B2 | 3/2020 | Appel et al. |
| 10,752,840 | B2 | 8/2020 | Cha et al. |
| 10,960,249 | B2 | 3/2021 | Hulbert et al. |
| 10,960,250 | B2 * | 3/2021 | Hulbert ..... A62D 1/005 |
| 10,960,251 | B1 | 3/2021 | Hulbert et al. |
| 11,041,063 | B2 | 6/2021 | Hulbert et al. |
| 11,344,760 | B2 | 5/2022 | Hulbert et al. |
| 2002/0013403 | A1 | 1/2002 | Vandersall |
| 2003/0010507 | A1 | 1/2003 | Greiner et al. |
| 2004/0074650 | A1 | 4/2004 | Shiga |
| 2004/0124403 | A1 | 7/2004 | Parker et al. |
| 2005/0001197 | A1 | 1/2005 | Clark |
| 2008/0196908 | A1 | 8/2008 | Schaefer |
| 2010/0063180 | A1 | 3/2010 | Kang et al. |
| 2011/0089386 | A1 | 4/2011 | Berry et al. |
| 2011/0105649 | A1 | 5/2011 | Harada et al. |
| 2011/0213065 | A1 | 9/2011 | Giesselbach et al. |
| 2012/0219947 | A1 | 8/2012 | Yurkovetsky et al. |
| 2012/0292551 | A1 | 11/2012 | Klaffmo |
| 2013/0180738 | A1 | 7/2013 | Kim et al. |
| 2013/0264509 | A1 | 10/2013 | Shalev et al. |
| 2015/0352744 | A1 | 12/2015 | Zhang et al. |
| 2015/0368560 | A1 | 12/2015 | Pascal et al. |
| 2016/0030789 | A1 | 2/2016 | Cordani |
| 2016/0264687 | A1 | 9/2016 | Tran |
| 2017/0056698 | A1 | 3/2017 | Pai et al. |
| 2018/0037998 | A1 | 2/2018 | Khosla et al. |
| 2018/0282218 | A1 | 10/2018 | Mabey |
| 2019/0153321 | A1 | 5/2019 | Simonovic |
| 2019/0322939 | A1 | 10/2019 | Kennedy et al. |
| 2020/0109253 | A1 | 4/2020 | Appel et al. |
| 2020/0384298 | A1 | 12/2020 | Hulbert et al. |
| 2020/0384299 | A1 | 12/2020 | Hulbert et al. |
| 2021/0009787 | A1 | 1/2021 | Hulbert et al. |
| 2021/0213318 | A1 | 7/2021 | Hulbert et al. |
| 2021/0213319 | A1 | 7/2021 | Hulbert et al. |
| 2021/0220687 | A1 | 7/2021 | Hulbert et al. |
| 2021/0309830 | A1 | 10/2021 | Hulbert et al. |
| 2022/0072355 | A1 | 3/2022 | Hulbert et al. |
| 2022/0080242 | A1 | 3/2022 | Hulbert et al. |

FOREIGN PATENT DOCUMENTS

| | | | |
|---|---|---|---|
| CN | 1225344 | A | 8/1999 |
| CN | 1446993 | A | 10/2003 |
| CN | 102417196 | A | 4/2012 |
| CN | 107880857 | A | 4/2018 |
| CN | 112391176 | A | 2/2021 |
| WO | 2006132568 | A2 | 12/2006 |
| WO | 2010059508 | A1 | 5/2010 |
| WO | 2019163839 | A1 | 8/2019 |
| WO | 2020247775 | A2 | 12/2020 |
| WO | 2020247780 | A1 | 12/2020 |

OTHER PUBLICATIONS

Blakely, "Laboratory method for evaluating forest fire retardant chemicals." (1970). 150 pages.

Byrd et al., "Characterizing short-wave infrared fluorescence of conventional near-infrared fluorophores." Journal of biomedical optics 24.3 (2019): 035004. 6 pages.

Cellulose. Wikipedia Dec. 6, 2018. Accessed at https://en.wikipedia.org/w/index.php?title=Cellulose&oldid=872356598 on Aug. 19, 2020. 12 pages.

Ding et al., "Recent advances in near-infrared II fluorophores for multifunctional biomedical imaging." Chemical science 9.19 (2018): 4370-4380.

Ecological Risk Assessment of Wildland Fire-Fighting Chemicals: Long-Term Fire Retardants. United States Forest Service Sep. 2017. Accessed at https://www.fs.fed.us/rm/fire/wfcs/documents/EcoRA-Retardants-ExecSummary_2017.pdf. 3 pages.

Evaluation of Wildland Fire Chemicals Standard Test Procedures STP 1.5—Fish Toxicity. USFS May 7, 2007. Accessed at https://www.fs.fed.us/rm/fire/wfcs/tests/documents/stp_01_5.pdf. 2 pages.

Fischel, "Evaluation of selected deicers based on a review of the literature." The SeaCrest Group, Report No. CDOT-DTD-R-2001-15 (Oct. 2001). 170 pages.

Fish Toxicity. US Forest Service Revised Sep. 6, 2017. Accessed at https://www.fs.fed.us/rm/fire/wfcs/performance/documents/FishTox_Foam.pdf. 2 pages.

Fiss et al., "Mechanochemical phosphorylation of polymers and synthesis of flame-retardant cellulose nanocrystals." ACS Sustainable Chemistry & Engineering 7.8 (2019): 7951-7959.

Grevel et al., "Experimentally determined standard thermodynamic properties of synthetic MgSO4—4H2O (starkeyite) and MgSO4—3H2O: A revised internally consistent thermodynamic data set for magnesium sulfate hydrates." Astrobiology 12.11 (2012): 1042-1054.

Grevel et al., "Internally consistent thermodynamic data for magnesium sulfate hydrates." Geochimica et Cosmochimica Acta 73.22 (2009): 6805-6815.

Hobbs, "Recent advances in bio-based flame retardant additives for synthetic polymeric materials." Polymers 11.2 (2019): 224. 31 pages.

Hollingbery et al., "The fire retardant behaviour of huntite and hydromagnesite—A review." Polymer degradation and stability 95.12 (2010): 2213-2225.

Huang et al., "Study on EPS thermal insulation mortar prepared by magnesium oxychloride cement." E3S Web of Conferences. vol. 198. EDP Sciences, 2020. 4 pages.

International Search Report and Written Opinion in International Patent Application No. PCT/US2020/036360 dated Nov. 30, 2020, 43 pages.

(56) References Cited

OTHER PUBLICATIONS

International Search Report and Written Opinion in International Patent Application No. PCT/US2020/036367 dated Sep. 9, 2020, 23 pages.
International Search Report in International Patent Application No. PCT/US2021/047726 dated Feb. 3, 2022, 21 pages.
Invitation to Pay Additional Fees, and where Applicable, Protest Fee in International Patent Application No. PCT/US2020/036360 dated Aug. 24, 2020, 6 pages.
Invitation to Pay Additional Fees, and where Applicable, Protest Fee in International Patent Application No. PCT/US2021/047726 dated Nov. 9, 2021, 4 pages.
Mostashari et al., "Thermal decomposition pathway of a cellulosic fabric impregnated by magnesium chloride hexahydrate as a flame-retardant." Journal of thermal analysis and calorimetry 93.2 (2008): 589-594.
Mostashari et al., "XRD characterization of the ashes from a burned cellulosic fabric impregnated with magnesium bromide hexahydrate as flame-retardant" Journal of thermal analysis and calorimetry 92.3 (2008): 845-849.
Non-Final Office Action in U.S. Appl. No. 17/031,024 dated Feb. 4, 2021, 9 pages.
Non-Final Office Action in U.S. Appl. No. 16/894,231 dated Dec. 10, 2020, 10 pages.
Perimeter Solutions, "Myth vs. Reality: Understanding the Chemistry of Wildfire Suppression" (Jun. 17, 2021), available at https://www.perimeter-solutions.com/wildfire-suppression-webinar/. 30 pages.
Qu et al., "The synergism of MgCO3 and 2ZnCO3• 3ZnO• 4H2O as flame retardants and smoke suppressants for flexible poly (vinyl chloride)(PVC)." e-Polymers 11.1 (2011). 9 pages.
Specification for Long Term Retardant, Wildland Fire, Aircraft or Ground Application. US Department of Agriculture Forest Service Specification 5100-304b. Jan. 2000. Accessed at https://www.fs.fed.us/rm/fire/documents/304_b.pdf. 24 pages.
Specification for Long Term Retardant, Wildland Firefighting. US Department of Agriculture Forest Service Specification 5100-304d. Jan. 7, 2020. Accessed at https://www.fs.fed.us/rm/fire/wfcs/Jocuments/5100-304d_LTR_Final%20Draft_010720.pdf. 32 pages.
Specification for Long Term Retardant, Wildland Firefighting. US Department of Agriculture Forest Service Specification 5100-304c. Jun. 1, 2007. https://www.fs.fed.us/rm/fire/wfcs/documents/304c.pdf. 30 pages.
Walter et al., "Overview of flame retardants including magnesium hydroxide." Martin Marietta Magnesia Specialties (2015). 9 pages.
Wu et al., "Comparative performance of three magnesium compounds on thermal degradation behavior of red gum wood." Materials 7.2 (2014): 637-652.
Wu et al., "Flame retardancy and thermal degradation behavior of red gum wood treated with hydrate magnesium chloride." Journal of Industrial and Engineering Chemistry 20.5 (2014): 3536-3542.
Zhang et al., "Flame Retardancy of High-Density Polyethylene Composites with P, N-Doped Cellulose Fibrils." Polymers 12.2 (Feb. 5, 2020): 336. 15 pages.
International Search Report and Written Opinion in PCT/US21/63598 dated Mar. 2, 2022 27 pages.

* cited by examiner

Aluminum coupons in FORTRESS FR-10D
Coupons 19 and 20 fully immersed at room temperature
Coupons 21 and 22 fully immersed at 125F
Coupons 23 and 24 half immersed at room temperature
Coupons 25 and 26 half immersed at 125F

LONG-TERM FIRE RETARDANT WITH CORROSION INHIBITORS AND METHODS FOR MAKING AND USING SAME

CROSS-REFERENCE TO RELATED APPLICATIONS

This application is a continuation of U.S. application Ser. No. 17/214,266, filed on Mar. 26, 2021, which is a continuation in part of U.S. application Ser. No. 16/894,214, filed on Jun. 5, 2020, which claims a priority benefit to U.S. provisional application Ser. No. 62/858,640, filed on Jun. 7, 2019, 62/989,350 filed on Mar. 13, 2020, and 63/024,040 filed on May 13, 2020, all of which are incorporated herein by reference in their entirety. U.S. application Ser. No. 17/214,266 is also a by-pass continuation of International Application No. PCT/US2020/036360 filed on Jun. 5, 2020, which claims a priority benefit to U.S. provisional application Ser. No. 62/858,640, filed on Jun. 7, 2019, 62/989,350 filed on Mar. 13, 2020, and 63/024,040 filed on May 13, 2020, all of which are incorporated herein by reference in their entirety.

BACKGROUND

Long-term retardants contain retardant salts that alter the way a forest fire burns, decrease the fire intensity, and slow the advance of the forest fire. Long-term retardants may be available as wet or dry concentrates that are mixed with water thereby improving water's effectiveness and ability to cling to fuels, over a long period of time. Long-term retardants may be colored with iron oxide, fugitive pigments, or remain uncolored.

In the "Ecological Risk Assessment of Wildland Fire-Fighting Chemicals: Long-Term Fire Retardants" (September 2017), hereby incorporated by reference in its entirety, the United States Forest Service ("USFS") has established a chemical toxicity risk assessment for fire-fighting chemicals currently approved for use by the USFS. The USFS uses a variety of fire-fighting chemicals to aid in the suppression of fire in wildlands. These products can be categorized as long-term retardants, foams, and water enhancers. This chemical toxicity risk assessment of the long-term retardants examines their potential impacts on terrestrial wildlife, plant, and aquatic species.

Further, in Specification 5100-304d (Jan. 7, 2020), Superseding Specification 5100-304b (July 1999), Superseding Specification 5100-00304a (February 1986), entitled "Specification for Long Term Retardant, Wildland Fire, Aircraft or Ground Application," hereby incorporated by reference in its entirety, the United States Department of Agriculture ("USDA") Forest Service has established the maximum allowable corrosion rates for 2024T3 aluminum, 4130 steel, yellow brass and Az-31-B magnesium. The corrosivity of forest fire retardants, in concentrate, to aluminum, steel, yellow brass and magnesium must not exceed 5.0 milli-inches ("mils") per year as determined by the "Uniform Corrosion" test set forth in Section 4.3.5.1 of the USDA Forest Service Specifications. The Forest Service Specifications identify the maximum amount of corrosion acceptable when both the retardant concentrate and its diluted solutions are exposed to each metal indicated above at temperatures of 70° Fahrenheit ("F") and 120° F. in both totally and partially immersed configurations. The maximum allowable corrosivity of aerially applied fire-retardant diluted solutions to aluminum is 2.0 mils per year ("mpy") and the maximum corrosivity to brass and steel is 2.0 mpy when partially immersed and 5.0 when tested in the partially immersed condition. In the partially immersed configurations, one-half of the coupon is within the solution and one-half is exposed to the vapors in the air space over the solution.

SUMMARY

The invention relates generally to fire retardant compositions and more particularly to long-term fire retardants suitable for use in direct or indirect attack of forest fires.

In one embodiment, a forest fire retardant composition includes a retardant compound, a corrosion inhibitor, a thickening agent, and at least one of a colorant, a dye, or a pigment. The retardant compound is at least one of a magnesium halide salt or a calcium halide salt, a carbonate salt comprising magnesium or calcium, a phosphate salt comprising magnesium or calcium, a metal oxide, or a metal hydroxide. The retardant compound may include a mixture of magnesium chloride and calcium chloride in a weight ratio (magnesium:calcium) of about 25%:75% to about 75%:25%. The retardant compound may include a mixture of an anhydrous salt and a hydrate salt in in a weight ratio (anhydrous:hydrate) from about 10%:90% to about 60%:40%. The metal oxide may include at least one of magnesium oxide (MgO), calcium oxide (CaO), sodium oxide ($Na_2O$), lithium oxide ($Li_2O$), or barium oxide (BaO). The retardant compound may include a metal hydroxide comprising at least one of magnesium hydroxide ($Mg(OH)_2$), calcium hydroxide, ($Ca(OH)_2$), sodium hydroxide (NaOH), lithium hydroxide (LiOH), barium hydroxide ($Ba(OH)_2$), or potassium hydroxide (KOH). The corrosion inhibitor may include a corrosion inhibitor for at least one of magnesium chloride, calcium chloride, magnesium bromide, calcium bromide, brass, iron, aluminum, steel, copper, or magnesium.

In another embodiment, a forest fire retardant composition includes a magnesium chloride salt comprising $MgCl_2$ anhydrous and $MgCl_2(H_2O)_6$, present in the composition in an amount having a weight ratio ($MgCl_2$ anhydrous:$MgCl_2(H_2O)_6$) of about 20:80 to about 50:50; a corrosion inhibitor for at least one of iron, brass, or aluminum, present in the composition in an amount having a weight percent of about 0.25% to about 5.0% relative to the weight of the magnesium chloride salt in the composition; a thickening agent, present in the composition in an amount having a weight percent of about 0.1% to about 4.5% relative to the weight of the magnesium chloride salt in the composition; a buffering agent, present in the composition in an amount having a weight percent of about 0.6% to about 3.0% relative to the weight of the magnesium chloride salt in the composition; a colorant, present in the composition in an amount having a weight percent of about 0.025% to about 2.0% relative to the weight of the magnesium chloride salt in the composition; a dye, present in the composition in an amount having a weight percent of about 0.025% to about 2.0% relative to the weight of the magnesium chloride salt in the composition; and a surfactant, present in the composition in an amount having a weight percent of about 0.0075% to about 1.25% relative to the weight of the magnesium chloride salt in the composition. The forest fire retardant composition may be in the form of a dry concentrate.

In another embodiment, a forest fire retardant liquid concentrate includes a magnesium salt solution comprising a magnesium salt dissolved in water, the magnesium salt being present in the solution in an amount having a weight percent of about 25% to about 35% relative to the total weight of the solution, and the solution being present in the liquid concentrate in an amount having a weight percent of about 85% to about 99% relative to the total weight of the liquid concentrate; a corrosion inhibitor for at least one of iron, brass, or aluminum, present in the liquid concentrate in an amount having a weight percent of about 0.5% to about 4.5% relative to the weight of the magnesium salt in the liquid concentrate; a thickening agent, present in the liquid concentrate in an amount having a weight percent of about 0.75% to about 5.0% relative to the weight of the magnesium salt in the liquid concentrate; a buffering agent, present in the liquid concentrate in an amount having a weight percent of about 0.25% to about 5.0% relative to the weight of the magnesium salt in the liquid concentrate; a colorant, present in the liquid concentrate in an amount having a weight percent of about 1.25% to about 4.5% relative to the weight of the magnesium salt in the liquid concentrate; a dye, present in the liquid concentrate in an amount having a weight percent of about 0.075% to about 1.2% relative to the weight of the magnesium salt in the liquid concentrate; and a surfactant, present in the liquid concentrate in an amount having a weight percent of about 0.025% to about 1.0% relative to the weight of the magnesium salt in the liquid concentrate.

In another embodiment, a method of manufacture includes combining the following components: (i) a retardant compound that includes at least one of: a magnesium halide salt or a calcium halide salt; a carbonate salt of magnesium or a carbonate salt of calcium; a phosphate salt of magnesium or a phosphate salt of calcium; a metal oxide; or a metal hydroxide; (ii) a corrosion inhibitor; (iii) a thickening agent; and (iv) at least one of a colorant, a dye, or a pigment. The components are combined via batch mixing or continuous mixing in a tumbler.

In another embodiment, a method of combating a forest fire includes: depositing, via aerial or ground-based application, a forest fire retardant composition that includes a retardant compound; a corrosion inhibitor; a thickening agent; at least one of a colorant, a dye, or a pigment; and water. The retardant composition includes at least one of: a magnesium halide salt or a calcium halide salt; a carbonate salt of magnesium or a carbonate salt of calcium; a phosphate salt of magnesium or a phosphate salt of calcium; a metal oxide; or a metal hydroxide. The step of depositing includes at least one of (a) a direct attack on the fire or (b) an indirect attack before the fire.

BRIEF DESCRIPTIONS OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

In General

Figure 1:
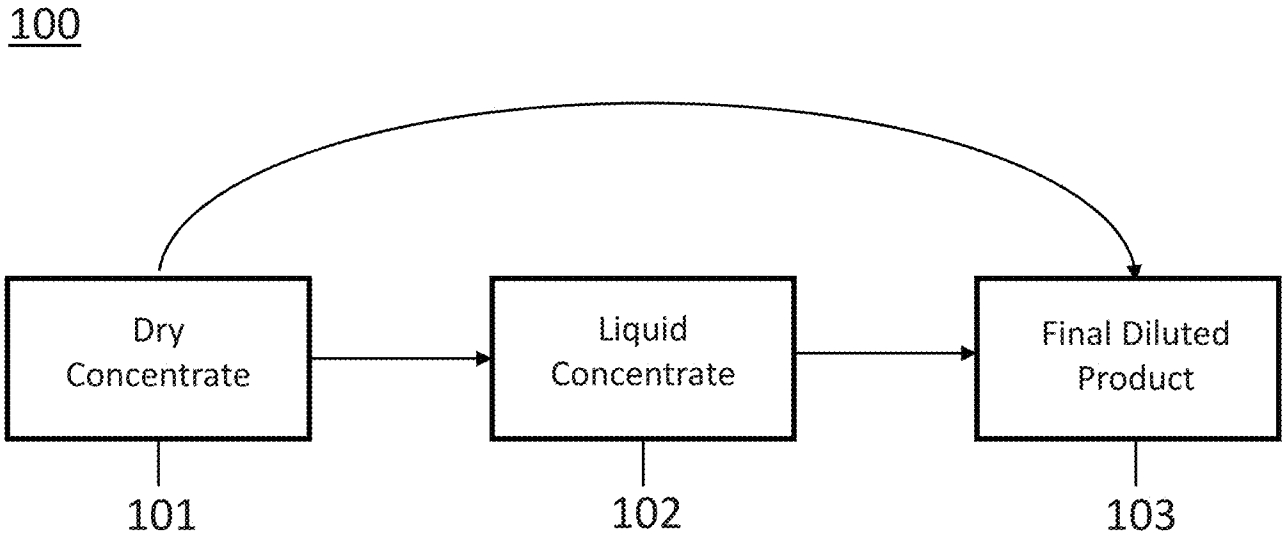
FIG. 1 is a flow chart diagram showing the process of making a forest fire retardant composition from a dry concentrate.

Referring to FIG. 1, a forest fire retardant composition 100 can be provided in various forms. The composition 100 can be provided as a dry concentrate 101 substantially free of water. Alternatively, the composition 100 can be provided as a liquid concentrate 102. The liquid concentrate 102 can be formed by adding water or other solvent(s) to the dry concentrate 101. Alternatively, liquid concentrate 102 is formed when the dry concentrate 101 is deliquescent, hygroscopic, and absorbs moisture from the air or other moisture source. The composition 100 can also be provided as a final diluted product 103 in a form suitable to fight forest fires via aerial- or ground-based application. The final diluted product 103 is formed either by diluting the dry concentrate 101 with water or by diluting the liquid concentrate 102 with water.

Figure 2:
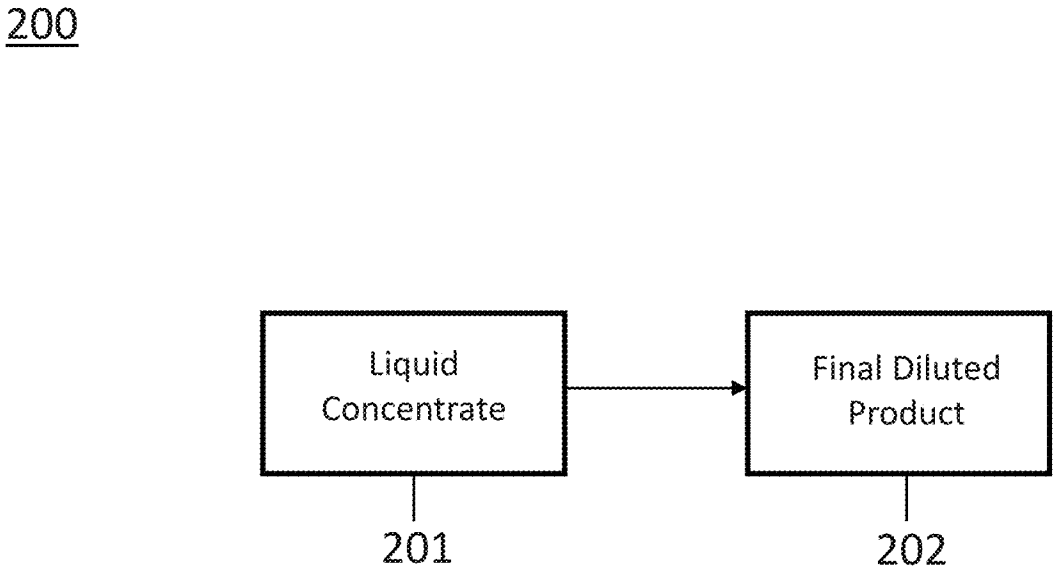
FIG. 2 is a flow chart diagram showing the process of making a forest fire retardant composition from a liquid concentrate.

Referring to FIG. 2, a forest fire retardant composition 200 can be provided in various liquid forms. The composition 200 can be provided as a liquid concentrate 201. The composition 200 can also be provided as a final diluted product 202 in a form suitable to fight forest fires via aerial- or ground-based application. The final diluted product 202 is formed by diluting the liquid concentrate 201 with water in one or more diluting steps.

Components of the Concentrates 100 and 200

The forest fire retardant compositions 100 and 200 include one or more retardant compounds. The retardant compounds are preferably inorganic compounds. Table 1 below illustrates exemplary inorganic compounds, any one or more of which may be used, alone or in combination, as a retardant compound in the compositions 100 and 200.

TABLE 1

| Exemplary Inorganic Retardant Compounds | | |
|---|---|---|
| Halide Salts | Non-Halide Salts | Other inorganic retardants |
| $MgCl_2$ | $MgCO_3$ | MgO |
| $MgCl_2(H_2O)_x$ where x is 1, 2, 4, 6, 8, or 12 | $Mg_3(PO_4)_2$ | CaO |
| $CaCl_2$ | $Mg_5(CO_3)_4(OH)_2(H_2O)_4$ | $Na_2O$ |
| $CaCl_2(H_2O)_x$ where x is 1, 2, 4, or 6 | $Mg_3(PO_4)_2(H_2O)_8$ | $Li_2O$ |
| $MgBr_2$ | $CaCO_3$ | BaO |
| $CaBr_2$ | $Ca_3(PO4)_2$ | $Mg(OH)_2$ |
| | $Mg_3Ca(CO_3)_4$ | $Ca(OH)_2$ |
| | $Ca_3(PO_4)_2(H_2O)_2$ | NaOH |
| | | LiOH |
| | | $Ba(OH)_2$ |
| | | KOH |

The retardant compound may be a salt. The salt may be a halide salt. The halide salt may include magnesium chloride. The magnesium chloride can be anhydrous, substantially free of any hydrate. Alternatively, or in combination with the anhydrous magnesium chloride, the magnesium chloride can be a hydrate, substantially free of any anhydrous. The hydrate may have the formula $MgCl_2(H_2O)_x$, where x is equal to at least one of 1, 2, 4, 6, 8, or 12. The magnesium chloride hydrate is preferably magnesium chloride hexahydrate having the formula $MgCl_2(H_2O)_6$.

Preferably, the magnesium chloride is present in the composition 100 in a combination of both magnesium chloride anhydrous and magnesium chloride hydrate. The magnesium chloride anhydrous and the magnesium chloride hydrate may be present in the forest fire retardant composition 100 in a weight ratio (anhydrous:hydrate) from about 00%:10000 to about 100%:0%, preferably from about 10%:90% to about 60%:40%, more preferably from about 20%:80% to about 50%:50%, and particularly from about 30%:70% to about 40%:60%. For example, the weight ratio (anhydrous:hydrate) in the composition 100 is about 33%:67% to about 38%:62%. It is preferred that the weight ratio (anhydrous:hydrate) in the composition 100 is about 36.4%:63.6%, wherein the hydrate is magnesium chloride hexahydrate.

Referring to FIG. 1, the composition 100 may begin as a dry concentrate 101 substantially free of water. As used herein, "substantially free of water," when referring to the dry concentrate 101, does not refer to the water of crystallization or water of hydration of the halide salt (i.e., the hydrate halide salt). In the dry concentrate 101, the weight percent of halide salt (including both anhydrous and hydrate) is about 75% to about 96%, preferably about 80% to about 95%, more preferably about 82% to about 94%, and particularly about 85% to about 93%. For example, the weight percent of halide salt (including both anhydrous and hydrate) in the dry concentrate 101 is about 88% to about 93%, and specifically about 89.9%±1.0%.

Preferably, the magnesium chloride is present in the composition 200 in a magnesium chloride solution including magnesium chloride and water. The water may be tap water, sea water, or water from other convenient water sources. Prior to the addition of any water used to make the magnesium chloride solution, the magnesium chloride may be magnesium chloride anhydrous and/or magnesium chloride hydrate. In the liquid concentrate 201, the magnesium chloride solution is about 15% to about 45% $MgCl_2$ by weight, more preferably 20% to 45%, and particularly about 25% to about 35%. Preferably, the amount of magnesium chloride in the solution is at or near the maximum soluble limit of magnesium chloride. For example, the magnesium chloride solution in the liquid concentrate 201 is about 28% to about 32% by weight, and specifically about 30% $MgCl_2$ by weight. The magnesium chloride solution may be a corrosion inhibited magnesium chloride solution or a non-corrosion inhibited magnesium chloride solution. The magnesium chloride is a corrosion inhibited magnesium chloride solution when it includes a corrosion inhibitor in the magnesium chloride solution. The non-corrosion inhibited magnesium chloride solution does not include a corrosion inhibitor in the magnesium chloride solution. The magnesium chloride solution (corrosion inhibited or non-corrosion inhibited) may include, but is not limited to, magnesium chloride solution (CAS Number: 7786-30-3) or magnesium chloride hexahydrate (CAS Number: 7791-18-6) from Sigma Aldrich, or FreezGard Lite CI Plus, FreezGard Zero CI Plus, FreezGard Zero CI Plus LS, FreezGard CI Plus Sub Zero, FreezGard CI Plus, DustGuard, DustGard Plus, FreezGard Zero, FreezGard Lite, or MagnaPro from Compass Minerals or Hydro-Melt Green or HydroMelt Liquid Deicer from Cargill, or Iceban 200, Caliber M1000 AP, Meltdown with Shield AP, Meltdown APEX with Shield AP, FreezGard CI Plus, Ice B'Gone II HF, Ice Ban 305, FreezGard 0 CCI, Meltdown Apex, Meltdown Inhibited, ProMelt MAG 30 INH, ProMelt Ultra 1000 INH, NexGen Torch, or NexGen Liquid De-Icer. The magnesium chloride can be extracted from brine or sea water and may also contains small amounts of other salts and impurities. Alternatively, the magnesium chloride solution may be formed by the addition of water or other solvent to solid magnesium chloride anhydrous and/or magnesium chloride hydrate. The anhydrous halide salt and the hydrate halide salt may be present in the liquid concentrate 201 in any ratio that results in a solution halide salt weight percent between 20% to 38%, preferably between 25% to 33% magnesium halide salt.

Instead of (or in addition to) chlorine, the magnesium halide salt may include bromine as the halogen which forms a magnesium bromide salt. The bromine may be used alone in the magnesium halide salt; alternatively, the bromine may be used in combination with chlorine, thereby forming a mixture of magnesium bromide and magnesium chloride salts. The bromine salt, when used as a bromine flame retardant, has a mechanism that is similar to chlorine and may be used as a long-term fire retardant alone or in combination with chlorine. Halogens or other compounds that liberate stable radicals in the thermal environment of the flame front also operate with a mechanism that is similar to chlorine and may be used as a long-term fire retardant.

Instead of (or in addition to) magnesium chloride, the halide salt of the forest fire retardant composition 100 may be calcium chloride. The calcium chloride can be anhydrous, substantially free of any hydrate. Alternatively, or in addition to the anhydrous calcium chloride, the calcium chloride can be a hydrate, substantially free of any anhydrous. The hydrate may have the formula $CaCl_2(H_2O)_x$, where x is equal to at least one of 1, 2, 4, or 6. Preferably, the calcium chloride is present in the composition 100 in a combination of both calcium chloride anhydrous and calcium chloride hydrate. In the dry concentrate 101, the weight percent of magnesium chloride (including both anhydrous and hydrate):calcium chloride (including both anhydrous and hydrate) is about 0%:100% to about 100%:0%, preferably about 10%:90% to about 90%:10%, more preferably about 25%:75% to about 75%:25%, and particularly around 45%:55% to about 55%:45%. For example, the weight percent of magnesium:calcium is about 50%:50%. The calcium chloride forest fire retardant composition may be used for a liquid concentrate. The calcium halide salt in the forest fire retardant composition 100 may include bromine as the halogen which forms a calcium bromide salt. The bromine may be used alone in the calcium halide salt; alternatively, the bromine may be used in combination with chlorine, thereby forming a mixture of calcium bromide and calcium chloride salts.

Instead of (or in addition to) magnesium chloride, the halide salt of the forest fire retardant composition 200 may be calcium chloride. The calcium chloride can be anhydrous, substantially free of any hydrate. Alternatively, or in addition to the anhydrous calcium chloride, the calcium chloride can be a hydrate, substantially free of any anhydrous. The hydrate may have the formula $CaCl_2(H_2O)_x$, where x is equal to at least one of 1, 2, 4, or 6. Preferably, the calcium chloride is present in the composition 200 in a calcium chloride solution including calcium chloride hydrate. Prior to the addition of any water used to make the calcium chloride solution, the calcium chloride may be calcium chloride anhydrous or calcium chloride hydrate. In the liquid concentrate 201, the calcium chloride solution is about 15% to about 45% $CaCl_2$, more preferably 20% to 45%, and particularly about 25% to about 35%. Preferably, the amount of calcium chloride in the solution is at or near the maximum soluble limit of calcium chloride. For example, the calcium chloride solution in the liquid concentrate 201 is about 28% to about 32%, and specifically about 30% $CaCl_2$. The calcium chloride solution may be a corrosion inhibited calcium chloride solution or a non-corrosion inhibited calcium chloride solution. The calcium chloride is a corrosion inhibited calcium chloride solution when it includes a corrosion inhibitor in the calcium chloride solution. The non-corrosion inhibited calcium chloride solution does not include a corrosion inhibitor in the calcium chloride solution. The calcium chloride solution (corrosion inhibited or non-corrosion inhibited) may include, but is not limited to, calcium chloride (CAS Number: 10043-52-4) from Sigma Aldrich, Liquid Dow Armor, Winter Thaw DI, Corguard TG, Road Guard Plus, Calcium Chloride with Boost (CCB), MeltDown Apex-C, or C1000 Pro. The calcium chloride can be extracted from brine or sea water and may also contains small amounts of other salts and impurities. Alternatively, the calcium chloride solution may be formed by the addition of water or other solvent to solid calcium chloride anhydrous and/or calcium chloride hydrate. The anhydrous halide salt and the hydrate halide salt may be present in the composition in any ratio that results in a solution halide salt concentration between 20% to 60%, preferably between 25% to 45% calcium halide salt.

In the liquid concentrate 201, the weight percent of magnesium chloride (including any hydrate(s)):calcium chloride (including any hydrate(s)) is about 0%:100% to about 100%:0%, preferably about 10%:90% to about 90%:10%, more preferably about 25%:75% to about 75%:25%, and particularly around 45%:55% to about 55%:45%. For example, the weight percent of magnesium:calcium is about 50%:50%. The calcium chloride forest fire retardant composition may be used for a liquid concentrate. The calcium halide salt in the forest fire retardant composition 200 may include bromine as the halogen which forms a calcium bromide salt. The bromine may be used alone in the calcium salt; alternatively, the bromine may be used in combination with chlorine, thereby forming a mixture of calcium bromide and calcium chloride salts.

Instead of (or in addition to) the halide salt, the salt of the forest fire retardant composition 100 and/or 200 may be a non-halide salt including at least one of magnesium non-halide salt, calcium non-halide salt, magnesium calcium non-halide salt, or a combination thereof. The anion in the salt may include at least one of carbonate or phosphate. The salt may include magnesium non-halide salt, which may be anhydrous magnesium non-halide salt or magnesium non-halide salt hydrate. The magnesium non-halide salt may include at least one of magnesium carbonate ($MgCO_3$), magnesium phosphate ($Mg_3(PO_4)_2$), magnesium carbonate hydroxide hydrate ($Mg_5(CO_3)_4(OH)_2(H_2O)_4$), or magnesium phosphate hydrate ($Mg_3(PO_4)_2(H_2O)_8$). As an alternative to using a magnesium non-halide salt, or in addition to using a magnesium non-halide salt, the non-halide salt may further include calcium non-halide salt, which may be anhydrous calcium non-halide salt or calcium non-halide salt hydrate. The calcium non-halide salt may include at least one of calcium carbonate ($CaCO_3$), calcium phosphate ($Ca_3(PO_4)_2$), huntite ($Mg_3Ca(CO_3)_4$), or calcium phosphate hydrate ($Ca_3(PO_4)_2(H_2O)_2$). The magnesium non-halide salt and calcium non-halide salt may be present in the forest fire retardant composition 100 and/or 200 in a weight ratio (magnesium:calcium) from about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the forest fire retardant composition 100 and/or 200, the weight percent of halide salt (including both anhydrous and hydrate):non-halide salt (including both anhydrous and hydrate) may be about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the liquid concentrate 201, the salt may be hydrated. In the liquid concentrate 201, the weight percent of liquid salt solution (including any hydrate(s)) is about 75% to about 100%, preferably about 80% to about 99.5%, more preferably about 85% to about 99%, and particularly about 90% to about 98.5%. For example, the weight percent of the liquid salt solution (including both anhydrous and hydrate) in the liquid concentrate 201 is about 92% to about 98%, and specifically about 96.5%±1.0%.

In the liquid concentrate 201, the weight percent of salt is about 10% to 70%, preferably about 15% to 55%, more preferably about 20% to about 50%, and particularly about 22% to about 45%. For example, the weight percent of the salt in the liquid concentrate 201 is about 25% to about 40%, and specifically about 26% to about 33%.

Instead of (or in addition to) the salt, the forest fire retardant composition 100 and/or 200 may contain a retardant component that includes a metal oxide and/or metal hydroxide. It is understood that the metal oxide, in the presence of water, can undergo a reversible reaction with water to form a metal hydroxide. The metal oxide includes magnesium oxide (MgO), calcium oxide (CaO), sodium oxide ($Na_2O$), lithium oxide ($Li_2O$), and barium oxide (BaO). The metal hydroxide includes magnesium hydroxide ($Mg(OH)_2$), calcium hydroxide, ($Ca(OH)_2$), sodium hydroxide (NaOH), lithium hydroxide (LiOH), barium hydroxide ($Ba(OH)_2$), or potassium hydroxide (KOH).

The metal oxide and metal hydroxide may be present in the forest fire retardant composition 100 and/or 200 in a weight ratio (oxide:hydroxide) from about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the forest fire retardant composition 100 and/or 200, the weight percent of metal oxide:salt (including halide and non-halide salt) may be about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the forest fire retardant composition 100 and/or 200, the weight percent of metal hydroxide:salt (including halide and non-halide salt) may be about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

The forest fire retardant composition 200 includes water or another solvent. The water in the liquid composition 200 may be tap water or water from other convenient water sources. Preferably, the water or other solvent is present in the composition 200 in the magnesium chloride or calcium chloride solution.

The forest fire retardant composition 100 and/or 200 may further include a corrosion inhibitor. The corrosion inhibitor includes an inhibitor for the magnesium chloride, calcium chloride, and an inhibitor for brass, iron, aluminum, steel, copper, or magnesium. The corrosion inhibitor for magnesium may include COBRATEC 928, Denatonium benzoate, benzoic acid, Diammonium phosphate, monoammonium phosphate, Wintrol SB 25Na, or a combination of the above. The corrosion inhibitor may include one or more azoles. The corrosion inhibitor may be a Wintrol® Super Azole Mix (Wintrol® SAM-H90 from Wincom, Inc). The Wintrol® SAM-H90 is designed for aqueous application. Wintrol® SAM-H90 provides corrosion resistance in highly corrosive environments caused by halogens, such chloride. Optionally, Wintrol® SAM-H38Na may be used as the corrosion inhibitor, alone or in combination with Wintrol® SAM-H90. The corrosion inhibitor may include but is not limited to, sodium selenite, sodium stearate, sodium benzoate, sodium fluoride, sodium phosphate, magnesium phosphate, benzotriazole-5-carboxylic acid, benzotriazole, 1,8-naphthalaldehydic acid, octadecylphosphonic acid, sodium dodecyl sulfonate (SDBS), Wintrol® BBT-25Na, Wintrol® BBT, Wintrol® THT-T, Wintrol® THT-35PG, Wintrol® THT-50K, Wintrol® SAM-H90, Wintrol SB 25Na, Wintrol® SAM-H38Na, Wintrol® SAM-H40(OS), Wintrol® SAM-B90, berberine, pyrrolidine riccione, catechin, lysergic acid, carmine, fast green, aniline, triethanolamine, p-chloroaniline, p-nitroaniline, p-methoxyaniline, p-methylaniline, sodium silicate, or a combination of the above.

The corrosion inhibitor may be present in the forest fire retardant composition 100 at a concentration of about 0.1 mM to 100 mM and more preferably at a concentration of about 10 mM to 50 mM. The corrosion inhibitor is effective at a salt concentration of about 2% to 9%, or about 3% to 8%, more preferably about 4% to 7%, and most preferably about 5% to 6%. The weight percent of the corrosion inhibitor, relative to the amount of the retardant compound in the composition 100, is about 0.25% to about 5.0%, for example about 0.5% to about 4.0%, or about 0.75% to about 3.0%, preferably about 0.9% to about 1.8%. For example, the weight percent of the corrosion inhibitor relative to the amount of retardant compound in the composition 100, is about 1.3%±0.2%.

In the dry concentrate 101, the weight percent of the corrosion inhibitor is about 0.6% to about 2.5%, preferably about 0.7% to about 2.5%, more preferably about 0.8% to about 2.0%, and particularly about 0.9% to about 1.8%. For example, the weight percent of the corrosion inhibitor in the dry concentrate 101 is about 1.0% to about 1.5%, and specifically about 1.3%±0.2%.

The weight percent of the corrosion inhibitor, relative to the amount of the retardant compound in the liquid composition 200, is about 0.25% to about 5.0%, preferably about 0.5% to about 4.5%, more preferably about 0.75% to about 4.0%, and specifically about 1.0% to about 3.5%. For example, the weight percent of the corrosion inhibitor, relative to the amount of retardant compound in the composition 200, is about 1.25% to about 3.0%, and specifically about 2.0%±0.5%.

To control the viscosity of the composition 100 and/or 200, the composition 100 and/or 200 may also include at least one thickening agent. The thickening agent may be a polyurethane, a polyvinyl alcohol, an acrylic polymer, a gum, a cellulosic, a sulfonate, a polyurethane, a saccharide, a clay, an organosilicone, or a protein, including but not limited to latex, styrene, butadiene, polyvinyl alcohol, attapulgite, bentonite, montmorillonite, algin, collagen, casein, albumin, castor oil, cornstarch, arrowroot, yuca starch, carrageenan, pullulan, konjac, alginate, gelatin, agar, pectin, carrageenan, chitosan, xanthan gum, guar gum, cellulose gum, acacia guar gum, locust bean gum, acacia gum, gum tragacanth, glucomannan polysaccharide gum, alginic acid, sodium alginate, potassium alginate, ammonium alginate, calcium alginate, carboxymethyl cellulose (CMC), methyl cellulose, hydroxyethyl cellulose (HEC), hydroxymethyl cellulose (HMC), hydroxypropyl methylcellulose (HPMC), ethylhydroxymethyl cellulose, hypromellose (INN), cetyl alcohol, cetearyl alcohol, polyethylene glycol (PEG), acrylic microgel, or acrylic amide wax.

The weight percent of the thickening agent(s), relative to the amount of the retardant compound in the composition 100, is about 0.005% to about 6.0%, preferably about 0.015% to about 5.0%, more preferably about 0.1% to about 4.5%, and specifically about 1.5% to about 4.0%. For example, the weight percent of the thickening agent(s), relative to the amount of the retardant compound in the composition 100, is about 3.2% to about 3.8%, and specifically about 3.5%±0.5%.

In one embodiment, the forest fire retardant composition 100 includes a first thickening agent. The first thickening agent may be a polysaccharide gum. The weight percent of the polysaccharide gum, relative to the amount of the retardant compound in the composition 100, is about 0.005% to about 4.0%, preferably about 0.05% to about 3.75%, more preferably about 0.25% to about 3.5%, and specifically about 0.5% to about 3.0%. For example, the weight percent of the polysaccharide gum, relative to the amount of the retardant compound in the composition 100, is about 1.00% to about 2.75%, and specifically about 2.1%±0.5%.

In another embodiment, the forest fire retardant composition 100 includes both the first thickening agent (discussed above) and a second thickening agent. The second thickening agent may be a chemically substituted cellulose or any other thickening agent listed above. The weight percent of the chemically substituted cellulose relative to the amount of the retardant compound in the composition 100, is about 0.005%% to about 3.0%, preferably about 0.05% to about 2.8%, more preferably about 0.2% to about 2.6%, and specifically about 0.6% to about 2.4%. For example, the weight percent of chemically substituted cellulose relative to the amount of the retardant compound in the composition 100, is about 0.8% to about 2.0%, and specifically about 1.4%±0.5%.

In the liquid concentrate 201, the weight percent of the thickening agent(s), relative to the amount of the retardant compound in the liquid concentrate 201, is about 0.25% to about 6.0%, preferably about 0.5% to about 5.5%, more preferably about 0.75% to about 5.0%, and specifically about 1.0% to about 4.5%. For example, the weight percent of the thickening agent(s), relative to the amount of the retardant compound in the composition 200, is about 1.25% to about 4.0%, and specifically about 2.3%±0.5%.

In one embodiment, the forest fire retardant composition 200 includes a first thickening agent. The first thickening agent may be a polysaccharide gum. The weight percent of the polysaccharide gum, relative to the amount of the retardant compound in the composition 200, is about 0.25% to about 6.0%, preferably about 0.5% to about 5.5%, more preferably about 0.75% to about 5.0%, and specifically about 1.0% to about 4.5%. For example, the weight percent of the polysaccharide gum, relative to the amount of the retardant compound in the composition 200, is about 1.25% to about 4.0%, and specifically about 2.3%±0.5%.

In another embodiment, the forest fire retardant composition 200 includes both the first thickening agent (discussed above) and a second thickening agent. The second thickening agent may be a chemically substituted cellulose, or any other thickening agent listed above.

To control the pH of the composition 100 and/or 200, the composition 100 and/or 200 may also include buffering agents such as organic amines including but not limited to triethanolamine ($C_6H_{15}NO_3$), diethanolamine, monoethanolamine, or monoethylene glycol and strong bases including but not limited to magnesium hydroxide ($Mg(OH)_2$), calcium hydroxide, ($Ca(OH)_2$), sodium hydroxide (NaOH), lithium hydroxide (LiOH), barium hydroxide ($Ba(OH)_2$), or potassium hydroxide (KOH).

The weight percent of the organic amine, relative to the amount of the retardant compound in the composition 100, is about 0.5% to about 5.0%, preferably about 0.6% to about 3.0%, more preferably about 0.75% to about 2.5%, and more specifically about 1.0% to about 2.2%. For example, the weight percent of organic amine, relative to the amount of the retardant compound in the composition 100, is about 1.2% to about 2.0%, and specifically about 1.3%±0.5%.

The weight percent of the organic amine, relative to the amount of the retardant compound in the composition 200, is about 0.25% to about 5.0%, preferably about 0.5% to about 4.5%, more preferably about 0.75% to about 4.0%, and specifically about 1.0% to about 3.5%. For example, the weight percent of the organic amine, relative to the amount of the retardant compound in the composition 200, is about 1.25% to about 3.0%, and specifically about 2.0%±0.5%.

The weight percent of strong base, relative to the amount of the retardant compound in the composition 100, is about 0.05% to about 3%, preferably about 0.1% to about 2.5%, more preferably about 0.2% to about 2.0%, and more specifically about 0.25% to about 1.5%. For example, the weight percent of strong base, relative to the amount of the retardant compound in the composition 100, is about 0.3% to about 1.0%, and specifically about 0.7%±0.5%.

The weight percent of strong base, relative to the amount of the retardant compound in the composition 200, is about 0.05% to about 4.0%, preferably about 0.1% to about 4.5%, more preferably about 0.15% to about 4.0%, and more specifically about 0.2% to about 3.5%. For example, the weight percent of strong base, relative to the amount of the retardant compound in the composition 200, is about 0.25% to about 3.0%, and specifically about 1.1%±0.5%.

The composition 100 and/or 200 may also include surfactant components including but not limited to a sodium dodecyl sulfate (SDS), sodium lauryl sulfate (SLS), sodium 4-dodecylbenzenesulfonate (SDBS), or a combination of the three to reduce surface tension and increase the spreading and wetting properties of the forest fire retardant composition 100 and/or 200.

The weight percent of surfactant, relative to the amount of the retardant compound in the composition 100, is about 0.005% to about 1.5%, preferably about 0.0075% to about 1.25%, more preferably about 0.01% to about 1.0%, and more specifically about 0.025% to about 0.75%. For example, the weight percent of surfactant, relative to the amount of the retardant compound in the composition 100, is about 0.05% to about 0.5%, and specifically about 0.08%±0.04%.

The weight percent of surfactant, relative to the amount of the retardant compound in the composition 200, is about 0.005% to about 1.75%, preferably about 0.0075% to about 1.5%, more preferably about 0.01% to about 1.25%, and more specifically about 0.025% to about 1.0%. For example, the weight percent of surfactant, relative to the amount of the retardant compound in the composition 200, is about 0.05% to about 0.75%, and specifically about 0.12%±0.1%.

The composition 100 and/or 200 may also include adjuvants including but not limited to triethanolamine, propylene glycol, propylene carbonate, RJ-7033, RJ-7077, Silwet HS-312, Silwet HS-604, Silwet 625, Silwet 641, Silwet PD, polyethylene glycol, or polypropylene glycol, or a combination of the above.

The composition 100 and/or 200 may also include titanium dioxide. The titanium dioxide may act as a pigment, for example, to provide a white pigment. The titanium dioxide may also act as a photo-responsive material to create opacity by scattering light or by protecting the components of the forest fire retardant composition 100 and/or 200 from UV degradation.

The weight percent of titanium dioxide, relative to the amount of the retardant compound in the composition 100, is about 0.02% to about 2.0%, preferably about 0.025% to about 1.75%, more preferably about 0.05% to about 1.5%, and more specifically about 0.1% to about 1.0%. For example, the weight percent of titanium dioxide, relative to the amount of the retardant compound in the composition 100, is about 0.2% to about 0.8%, and specifically about 0.6%±0.3%.

The weight percent of titanium dioxide, relative to the amount of the retardant compound in the composition 200, is about 0.02% to about 3.0%, preferably about 0.025% to about 2.75%, more preferably about 0.05% to about 2.5%, and more specifically about 0.1% to about 2.0%. For example, the weight percent of titanium dioxide, relative to the amount of the retardant compound in the composition 200, is about 0.2% to about 1.75%, and specifically about 0.97%±0.5%.

The composition 100 and/or 200 may also include a colorant. The colorant may be a fugitive colorant, a non-fugitive colorant, or a combination of the two. The composition 100 and/or 200 has a first hue which is a color, i.e., either colorless or a color which blends with the normal vegetation and/or ground in the drop zone. This first hue may be grey or white or a combination of the two. The colorant initially colors the composition 100 and/or 200 to a second hue which contrasts with the hue of the ground vegetation. The colorant may be a fugitive component such as a dye or a dye which is dispersed in a matrix (i.e., a pigment), which fades over time and under ambient field conditions to a colorless or less highly colored hue. Preferably the colorant is one that is compatible with magnesium chloride or calcium chloride such as colorants that have been used in de-icing, dust control, or fertilizers. The fugitive colorant may fade over time with exposure to sunlight.

Several fugitive component dyes and pigments can be used as a colorant. For example, many water-soluble dyes fade rapidly and there are so-called fluorescent pigments (fluorescent dyes encapsulated in a resin integument) which are suspended in forest fire retardant compositions and which also fade rapidly to provide a fugitive effect. Examples of fugitive dyes and pigments include, but are not limited to, C.I. Basic Red I dye, 6BL dye, Basic Violet II dye, Basic Yellow 40, acid fuchsin, basic fuchsin, new fuchsin, acid red 1, acid red 4, acid red 8, acid red 18, acid red 27, acid red 37, acid red 88, acid red 97, acid red 114, acid red 151, acid red 183, acid red 183, fast red violet 1B base, solvent red, Rhodamine B, Rhodamine 6G, Rhodamine 123, Rhodamine 110 chloride, erythrosine B, Basacryl red, Phloxine B, rose Bengal, direct red 80, direct red 80, Sudan red 7B, Congo red, neutral red, Fluorescent Red Mega 480, Fluorescent red 610, Fluorescent red 630, Fluorescent Red Mega 520, Pylaklor Red S-361, Pylaklor Scarlet LX-6364A Pylam Bright Red LX-1895 Pylam Coral LX-1801, FD&C Red #3, FD&C Red #4, FD&C Red #40, FD&C Red #4 Lake, D&C Red #33, D&C Red #33 Lake, and encapsulated-dye pigments which are available commercially, e.g., the "AX" series pigments, supplied by Day-Glo Color Corp., Cleveland, Ohio. The dye may be Liquitint 564 ($\lambda$=564 nm) or Liquitint Agro Pink 564 ($\lambda$=564 nm) from Milliken & Company (Spartanburg, S.C.).

The colorant may be a colorant from Greenville Colorants (New Brunswick, N.J.) or Milliken & Company (Spartanburg, S.C.). For example, the colorant is a colorant that is compatible for use with magnesium chloride, such as colorants used in magnesium chloride dust-control and road-stabilization formulations, or in magnesium chloride de-icing formulations. The colorant may be Elcomine Scarlet NAS, Elcomine Scarlaet NAS EX, or Iron Oxide GC-110P from Greenville Colorants. The colorant may be a combination of Liquitint 564 and Iron Oxide GC-110P.

The colorant of the composition 100 and/or 200 may be a dye or include encapsulated-dye fugitive pigments without ultraviolet absorbers. Compared to water soluble dyes, encapsulated-dye pigments are less likely to permanently stain the normal vegetation and/or ground in the drop zone. The fugitive component is present in an amount which provides a color (second hues) to the forest fire retardant composition 100 and/or 200 which is contrasts with the color of the vegetation and/or ground in the drop zone (normally green, blue-green and/or brown). Advantageously, the second hue is red, orange or pink. The color of the dye may be red, orange, purple, or pink or any combination of the four. Preferably, the dye is one that is compatible with magnesium chloride.

The colorant may also include a non-fugitive component, i.e., a component which is insoluble in the carrier liquid and which, if colored, does not necessarily fade after aerial application of the forest fire retardant composition 100 and/or 200. The non-fugitive component of the colorant is present in an amount sufficient to improve the aerial visibility of the composition when it is first applied to the vegetation. However, the non-fugitive component is present in less than an amount which prevents the composition from thereafter fading a neutral color. The colorant may be a combination of the fugitive and non-fugitive components. The non-fugitive component in the forest fire retardant composition 100 and/or 200 may be iron oxide ($Fe_2O_3$ and/or $Fe_3O_4$). The iron oxide may be present in combination with the fugitive colorant described above and titanium dioxide or it may be present alone.

The weight percent of colorant or Iron Oxide, relative to the amount of the retardant compound in the composition 100, is about 0.02% to about 3.0%, preferably about 0.025% to about 2.0%, more preferably about 0.05% to about 1.5%, and more specifically about 0.075% to about 1.2%. For example, the weight percent of colorant or Iron Oxide, relative to the amount of the retardant compound in the composition 100, is about 0.1% to about 1.0%, and specifically about 0.6%±0.3%.

The weight percent of dye, relative to the amount of the retardant compound in the composition 100, is about 0.02% to about 3.0%, preferably about 0.025% to about 2.0%, more preferably about 0.05% to about 1.5%, and more specifically about 0.075% to about 1.2%. For example, the weight percent of dye, relative to the amount of the retardant compound in the composition 100, is about 0.1% to about 1.0%, and specifically about 0.6%±0.3%.

The weight percent of colorant or Iron Oxide Black, relative to the amount of the retardant compound in the composition 200, is about 0.25% to about 6.0%, preferably about 0.5% to about 5.75%, more preferably about 0.75% to about 5.5%, and more specifically about 1.0% to about 5%. For example, the weight percent of colorant or Iron Oxide Black, relative to the amount of the retardant compound in the composition 200, is about 1.25% to about 4.5%, and specifically about 2.9%±1%.

The weight percent of dye, relative to the amount of the retardant compound in the composition 200, is about 0.02% to about 3.0%, preferably about 0.025% to about 2.0%, more preferably about 0.05% to about 1.5%, and more specifically about 0.075% to about 1.2%. For example, the weight percent of dye, relative to the amount of the retardant compound in the composition 200, is about 0.1% to about 1.0%, and specifically about 0.7%±0.4%.

The composition 100 and/or 200 may also include a glow-in-the-dark additive. The glow-in-the-dark additive improves the visibility of the fire retardant composition during periods of darkness. Nighttime visibility of the composition is improved, for example, to the naked human eye and/or using imaging equipment such as goggles. The glow-in-the-dark additive can include one or more phosphorescent additives that imparts photoluminescence properties to the forest fire retardant composition 100 and/or 200. The phosphorescent additive may exhibit fluorescence and/or phosphorescence. The phosphorescent additive may be charged with sunlight or artificial lighting, such as UV radiation or Fluorescent lighting. The phosphorescent additive may emit light in the visible light region or in the ultraviolet region. Alternatively, the phosphorescent additive may emit light in the near infrared region and be visualized using infrared goggles. Examples of the phosphorescent additive include LumiNova, LumiNova Green (G), LumiNova G PS-2, LumiNova Blue Green (BG), a zinc sulfide pigment, or mixtures thereof. The amount of the glow-in-the-dark additive, relative to the amount of composition 100 and/or 200 is about 100 g/1000 L to about 1000 g/1000 L, preferably about 200 g/1000 L to about 800 g/1000 L, and more preferably about 300 g/1000 L to about 700 g/1000 L. For example, the amount of the glow-in-the-dark additive, relative to the amount of composition 100 and/or 200 is about 350 g/1000 L to about 550 g/1000 L.

The glow-in the-dark additive may also include one or more fluorophores. The fluorophore(s) may exhibit fluorescence and/or phosphorescence. The fluorophore(s) may be visible in the near infrared region (i.e., 700 nm-1700 nm wavelength of light). Visualization can be achieved using near infrared goggles. Examples of fluorophores include CH1055 (4.8-Bis(2-(4-(bis(4-(2-carboxyethyl)phenyl) amino)phenyl)-5H-[1,2,5]thiadiazolo[3,4-f]benzo[c][1,2,5] thiadiazole), as well as Cy7 or Cy7.5, or mixtures thereof.

The composition 100 and/or 200 may optionally include other ingredients, such as spoilage inhibitors, flow conditioners, anti-foaming agents, foaming agents, stability additives, biocide, thickening agents, surfactants, adjuvants, corrosion inhibitors other than those of the corrosion inhibiting system, opacifiers, additional coloring agents, liquid carrier, and water.

Formation of the Dry Concentrate 101

The dry components of the forest fire retardant composition 100 are batch mixed in a tumbler to form a dry concentrate 101. Alternatively, the dry components may be continuously mixed. First, the magnesium chloride hexahydrate and magnesium chloride anhydrous are mixed together. Then, the remaining dry ingredients (thickening agent(s), titanium dioxide, sodium dodecyl sulfate, colorant, and dye) are added to the mixture. Finally, the two liquid components (triethanolamine and Wintrol® SAM-H90) are slowly added to the mixture while mixing. The dry concentrate 101 is then stored, substantially in the absence of air and/or external moisture, in a sealed bag having a plastic liner and/or moisture barrier. For example, each sealed bag can contain about 2,000 pounds of the dry concentrate 101 during storage and shipment to the point of use (e.g., airfield). Alternatively, the dry concentrate 101 may be stored in lined one-ton tote sacks or super sacks. Air-sealed bags with a plastic liner supplied by Semi-Bulk Systems Inc. (St. Louis, Mo.) can be used. Alternatively, an air-permeable moisture barrier can be used, such as a barrier made of a silicone material. The dry concentrate 101 is substantially free of water. The dry composition 101 is chemically stable under normal temperatures and pressures. The dry concentrate 101 should be protected from exposure to humidity and moisture on moisture-proof air pallets or under a water-resistant tarp during storage. The dry concentrate 101 may be supplied as part of a kit that includes a sealed container substantially in the absence of air and/or external moisture (e.g., air-sealed bag, air-permeable moisture sealed bag, tote sack, super sack) and instructions for using the dry concentrate 101 to form the final diluted product 103 (described below). In the case where the final diluted product 103 is to be applied on a localized scale by homeowners or local officials, for example, the kit may contain a tank for mixing and applying the final diluted product 103 (e.g., a 1-2 gallon hand-held or 4 gallon backpack or 5 gallon cart-style container with an applicator wand and/or hose, or a 15-25 gallon tank capable of being mounted on or pulled behind an all-terrain vehicle or truck), and instructions for using the dry concentrate 101 to form and apply the final diluted product 103.

Forming the Intermediate Liquid Concentrate 102

The liquid concentrate 102 may be formed by the addition of water or other solvent to the dry concentrate 101. The water may be tap water or water from other convenient water sources. Alternatively, the liquid concentrate 102 may be formed upon absorption of moisture by the dry concentrate 101 if the dry concentrate 101 is deliquescent. Magnesium chloride hexahydrate is deliquescent and will form an aqueous solution if exposed to air.

The dry concentrate 101 is first mixed to disperse the thickening agent(s) in the dry blend before any liquid additions. The dry concentrate 101 is agitated to prevent clumping of the dry components when batch mixed with water or other solvent to form the liquid concentrate 102. Alternatively, the liquid concentrate 102 may be prepared using continuous mixing equipment. Alternatively, the water or other solvent may be added by spraying onto a ribbon of well-mixed dry ingredients. For example, the water or other solvent could be sprayed onto the dry components while traveling across a conveyor belt. Once mixed, the liquid concentrate 102 is then stored, substantially in the absence of air, in a sealed container. For example, the sealed container for storage and shipment to the point of use (e.g., airfield) may be a 1,000 L tote, a 5-gallon pail or a 55-gallon drum. The liquid concentrate 102 is chemically stable under normal temperatures and pressures.

In the liquid concentrate 102, the weight percent of the retardant compound is about 10% to about 70%, preferably about 15% to about 65%, more preferably about 20% to about 60%. For example, the weight percent of the retardant compound in the liquid concentrate 102 is about 25% to about 55%, and specifically about 48%±3%.

The salt in the liquid concentrate 102 composition may include up to 100% hydrated salt (and 0% anhydrous salt). The hydrated salt may be at least one of magnesium chloride or calcium chloride. The weight percent of magnesium chloride hydrate is about 5% to about 40%. The liquid concentrate 102 composition may also include additional bromine salt in a weight percent of about 5% to about 50%.

Instead of (or in addition to) the salt, the liquid concentrate 102 may include a metal oxide and/or a metal hydroxide. It is understood that the metal oxide, in the presence of water, can undergo a reversible reaction with water to form a metal hydroxide. The weight percent of metal hydroxide may be about 2% to about 60%, preferably about 5% to about 50%, more preferably about 7% to about 45%. For example, the concentration of metal hydroxide in the liquid concentrate 102 may be about 8% to about 40%, and specifically about 32%±3%.

The liquid concentrate 102 may be supplied as part of a kit that includes a sealed container for storage and shipment substantially in the absence of air and/or external moisture (e.g., 1,000 L tote, a 5-gallon pail or a 55-gallon drum) and instructions for using the liquid concentrate 102 to form the final diluted product 103 (described below). In the case where the final diluted product 103 is to be applied on a localized scale by homeowners or local officials, for example, the kit may contain a tank for mixing and applying the final diluted product 103 (e.g., a 1-2 gallon hand-held or 4 gallon backpack or 5 gallon cart-style container with an applicator wand and/or hose, or a 15-25 gallon tank capable of being mounted on or pulled behind an all-terrain vehicle or truck), and instructions for using the liquid concentrate 102 to form and apply the final diluted product 103.

Forming the Final Diluted Product 103

The final diluted product 103 is formed either directly from the dry concentrate 101 by mixing the dry concentrate 101 with water or by mixing the liquid concentrate 102 with water. The dry concentrate 101 or the liquid concentrate 102 is shipped to the point of use (e.g., airfield), where it is diluted with water or other solvent to form the final diluted product 103. The dry concentrate 101 is added slowly into room temperature (or cooler) water with stirring. The dry concentrate 101 is designed for addition to water at a weight ratio of approximately 100 grams of dry concentrate 101 to 492 grams of water. The water may be tap water or water from other convenient water sources. The product is mixed using the current mixing equipment available to the USFS.

The reaction is exothermic and may reach a maximum temperature between about 100° F. to about 110° F. The product is stirred for about 30 minutes before being allowed to stand to develop a stable viscosity. The final diluted product 103 can also be prepared on a commercial batch scale by combining the dry concentrate 101 with a measured amount of water in an appropriate mix vessel such as an agitated mix tank. Alternatively, the final diluted product 103 may be prepared on a commercial batch scale using continuous mixing equipment. The rate of addition of solid concentrate to water should be controlled to assure efficient mixing of the concentrate and the water. Alternately, a continuous process may be conducted by introducing the dry concentrate 101 into a water stream via a vacuum eductor system where the ratio of flow through the eductor port to the bypass flow is roughly 1:9. Downstream mixing should be accomplished to avoid product settling in the receiving tank, or the receiving tank itself should be vigorously circulated to facilitate solution and adequate hydration of the dry concentrate 101.

The final diluted composition 103 can also be batch mixed by feeding the dry concentrate 101 into a well-circulated mix-batch tank. Alternatively, the final diluted composition 103 may be mixed using continuous mixing equipment. Mix tank agitation may be provided via an overhead mechanical stirring apparatus or alternatively by a circulation pump sized to provide turbulent mixing. Alternatively, a venturi-type vacuum eductor mixer or an in-line high-shear mixer can be used. For batch mixing, the mix water is agitated or circulated to provide efficient mixing, then a one-ton sack of dry concentrate 101 is added slowly, typically by suspending the sack over the mix tank (via a fork lift or by other manner), and opening the discharge spout on the sack to allow product to flow out of the sack into the mix solution. The addition rate should be controlled to avoid settling of the solid concentrate in the mix tank. The resulting mixture of dry concentrate 101 will provide approximately 1300 gallons of mixed retardant. The final diluted product 103 is in a form suitable to fight forest fires via aerial- or ground-based application.

The dry concentrate 101 may be diluted with water so that the final diluted product 103 has a retardant compound (e.g. salt) weight percent of about 2% to about 70%, preferably about 5% to about 40%, more preferably about 7% to about 30%. For example, the concentration of retardant compound (e.g., salt) in final diluted product 103 is about 8% to about 25%, and specifically about 17%±2%.

The liquid concentrate 102 may be diluted with water so that the final diluted product 103 has a retardant compound (e.g. salt) weight percent of about 2% to about 70%, preferably about 5% to about 40%, more preferably about 7% to about 30%. For example, the concentration of retardant compound (e.g., salt) in final diluted product 103 is about 8% to about 25%, and specifically about 17%±2%.

The dry concentrate 101 may be diluted with water so that the final diluted product 103 has a salt concentration of about 300 grams to about 900 grams of salt per gallon of water, preferably about 450 grams to about 800 grams of salt per gallon of water, more preferably about 500 grams to about 750 grams of salt per gallon of water. For example, the salt concentration in the final diluted product 103, may be about 550 grams to about 700 grams of salt per gallon of water, and specifically about 690±30 grams of salt per gallon of water.

The liquid concentrate 102, may be diluted at a 2:1 ratio (water:liquid concentrate) to form the final diluted product 103. The liquid concentrate 102 may be diluted with water so that the final diluted product 103 has a salt concentration of about 300 grams to about 900 grams of salt per gallon of water, preferably about 450 grams to about 800 grams of salt per gallon of water, more preferably about 500 grams to about 750 grams of salt per gallon of water. For example, the salt concentration in the final diluted product 103, may be about 550 grams to about 700 grams of salt per gallon of water, and specifically about 690±30 grams of salt per gallon of water.

The final diluted product 103 is a long-term forest fire retardant with improved aerial visibility for either a direct or indirect attack. The resulting final diluted product 103 is an opaque reddish suspension that resists settling. The final diluted product 103 should be mixed approximately every 7-10 days to ensure uniform density. The viscosity of the final diluted product 103 can be adjusted to accommodate a variety of aircrafts by adjusting the amounts of thickening agent(s) added to the mixture. The final diluted product 103 may be a medium viscosity long term retardant. The viscosity may be in the range of 300 cP to 800 cP, and more preferably the viscosity may be about 460 cP at 70° F. After 24 hours the viscosity may be about 485 cP. The final diluted product 103 may alternatively be a high viscosity long term retardant through the addition of more thickening agent. Alternatively, the final diluted product 103 may be a low viscosity long term retardant through the use of less thickening agent. The pH of the final diluted product 103 may be in the range of 8 to 9, and more preferably the pH may be 8.19 at 70° F. The freezing temperature of the final diluted product 103 may be in the range of 15° F. to 25° F., and more preferably the freezing temperature is 18° F. Once blended with water, the final diluted product 103 is a homogeneous, stable fluid that requires only infrequent stirring. The final diluted product 103 is hydrated into a stable mixture in 20 minutes, without the use of special equipment.

Forming the Liquid Concentrate 201

The components of the forest fire retardant composition 200 are batch mixed to form a liquid concentrate 201. Alternatively, the forest fire retardant composition 200 may be mixed using continuous mixing equipment. The mixing should be controlled to ensure that all of the dry components are adequately dispersed and hydrated to ensure that the formulation is maintained. The water in the liquid composition 201 may be tap water or water from other convenient water sources. The liquid composition 201 is chemically stable under normal temperatures and pressures. Once mixed, the liquid concentrate 201 is then stored, substantially in the absence of air and/or external moisture, in a sealed container. The liquid concentrate 201 should be protected from exposure to humidity and moisture. For example, the sealed container for storage and shipment to the point of use (e.g., airfield) may be a 1,000 L tote, a 5-gallon pail or a 55-gallon drum. The liquid concentrate 201 is chemically stable under normal temperatures and pressures.

The liquid concentrate 201 may be a viscous liquid concentrate. The viscosity may be in the range of 1500 cP to 2500 cP, and more preferably the viscosity may be about 1750 cP to 2250 cP at 70° F. For example, the viscosity of the liquid concentrate 201 may be about 1970 to 2090 cP at 70° F. The final diluted product 202 may alternatively be a high viscosity long term retardant through the addition of more thickening agent. The pH of the liquid concentrate 201 may be in the range of 5 to 7, and more preferably the pH may be 6.85 at 70° F. The freezing temperature of the liquid concentrate 201 may be in the range of −10° F. to 10° F., and more preferably the freezing temperature is 0° F.

The liquid concentrate 201 composition may include up to 100% hydrated salt. The hydrated salt may be at least one of magnesium chloride or calcium chloride. The salt weight percent of magnesium chloride hydrate or calcium chloride hydrate is about 5% to about 40%. The liquid concentrate 201 composition may also include additional bromine salt in a weight percent of about 5% to about 50%.

Instead of (or in addition to) the salt, the liquid concentrate 201 may include a metal oxide and/or a metal hydroxide. It is understood that the metal oxide, in the presence of water, can undergo a reversible reaction with water to form a metal hydroxide. The weight percent of metal hydroxide may be about 2% to about 60%, preferably about 5% to about 50%, more preferably about 7% to about 45%. For example, the concentration of metal hydroxide in the liquid concentrate 201 is about 8% to about 40%, and specifically about 30%±3%.

The liquid concentrate 201 may be supplied as part of a kit that includes a sealed container for storage and shipment, substantially in the absence of air and/or external moisture, (e.g., 1,000 L tote, a 5-gallon pail or a 55-gallon drum) and instructions for using the liquid concentrate 201 to form the final diluted product 202 (described below). Air-sealed bags with a plastic liner supplied by Semi-Bulk Systems Inc. (St. Louis, Mo.) can be used. Alternatively, an air-permeable moisture barrier can be used, such as a barrier made of a silicone material. In the case where the final diluted product 202 is to be applied on a localized scale by homeowners or local officials, for example, the kit may contain a tank for mixing and applying the final diluted product 202 (e.g., a 1-2 gallon hand-held or 4 gallon backpack or 5 gallon cart-style container with an applicator wand and/or hose, or a 15-25 gallon tank capable of being mounted on or pulled behind an all-terrain vehicle or truck), and instructions for using the liquid concentrate 201 to form and apply the final diluted product 202.

Forming the Final Diluted Product 202

The final diluted product 202 is formed by mixing the liquid concentrate 201 with water. The liquid concentrate 201 is shipped to the point of use (e.g., airfield), where it is diluted with water or other solvent to form the final diluted product 202. The liquid concentrate 201 may be designed for addition to water at a weight ratio of approximately 4.4 pounds of liquid concentrate 201 to one gallon of water. The water may be tap water or water from other convenient water sources. The product is mixed using the current mixing equipment available to the USFS. The liquid concentrate 201 is slowly added to a pre-measured and well-stirred tank of water to provide a finished ratio of 1.00:1.895 (liquid concentrate:water) on a weight/weight basis. The liquid concentrate 201 is very miscible in water and special mixing precautions are not necessary other than to limit splash escaping the mixing vessel. The tank contents should be circulated via a centrifugal pump or another stirring means to ensure uniform mixing.

The reaction is exothermic and may reach a maximum temperature between about 100° F. to about 110° F. The product is stirred for about 20-30 minutes before being allowed to stand to develop a stable viscosity and ensure a uniform mixture. The final diluted product 202 can also be prepared on a commercial batch scale by combining the liquid concentrate 201 with a measured amount of water in an appropriate mix vessel such as an agitated mix tank. Alternatively, the final diluted composition 202 may be prepared on a commercial batch scale using continuous mixing equipment. The rate of addition of liquid concentrate to water should be controlled to assure efficient mixing of the concentrate and the water. The final diluted product 202 forms a stable suspension and should be stirred after standing to eliminate any settling of the components.

The final diluted composition 202 can also be batch mixed by feeding the liquid concentrate 201 into a well-circulated mix-batch tank. Alternatively, the final diluted composition 202 may be mixed using continuous mixing equipment. Mix tank agitation may be provided via an overhead mechanical stirring apparatus or alternatively by a circulation pump sized to provide turbulent mixing. Alternatively, a venturi-type vacuum eductor mixer or an in-line high-shear mixer can be used. The final diluted product 202 is in a form suitable to fight forest fires via aerial- or ground-based application.

The liquid concentrate 201 may be diluted with water so that the final diluted product 202 has a salt concentration of about 200 grams to about 650 grams of salt per gallon of the final diluted product, preferably about 250 grams to about 600 grams of salt per gallon of the final diluted product, more preferably about 300 grams to about 550 grams of salt per gallon of the final diluted product. For example, the salt concentration in the final diluted product 202, is about 350 grams to about 500 grams of salt per gallon of the final diluted product, and specifically about 412±30 grams of salt per gallon of the final diluted product.

The liquid concentrate 201 may be diluted at about a 1.00:1.895 (liquid concentrate:water) on a weight/weight basis to form the final diluted product 202. The liquid concentrate 201 may be diluted with water so that the final diluted product 202 has about 200 grams to about 650 grams of salt per gallon of the final diluted product, preferably about 250 grams to about 600 grams of salt per gallon of the final diluted product, more preferably about 300 grams to about 550 grams of salt per gallon of the final diluted product. For example, the salt concentration in the final diluted product 202, is about 350 grams to about 500 grams of salt per gallon of the final diluted product, and specifically about 412±30 grams of salt per gallon of the final diluted product.

In the final diluted product 202, the weight percent of retardant compound (e.g., salt) is about 2% to about 70%, preferably about 5% to about 40%, more preferably about 7% to about 30%. For example, the concentration of retardant compound (e.g., salt) in final diluted product 202 is about 8% to about 15%, and specifically about 10%±2%.

The final diluted product 202 is a long-term non-fugitive forest fire retardant with improved aerial visibility for either a direct or indirect attack. The resulting final diluted product 202 is an opaque pink or red-purple suspension that resists settling. The final diluted product 202 should be mixed approximately every 7-10 days to ensure uniform density. The viscosity of the final diluted product 202 can be adjusted to accommodate a variety of aircrafts by adjusting the amounts of thickening agent(s) added to the mixture. The final diluted product 202 may be a medium viscosity long term retardant. The viscosity may be in the range of 100 cP to 250 cP, more preferably in the range of 150 cP to 220 cP, and more preferably the viscosity may be about 155 cP to 200 cP at 70° F. For example, the viscosity of the final diluted product 202 may be about 160 to 180 cP, for example about 170 cP. The final diluted product 202 may alternatively be a high viscosity long term retardant through the addition of more thickening agent.

Alternatively, the final diluted product 202 may be a low viscosity long term retardant through the use of less thickening agent. The pH of the final diluted product 202 may be in the range of 8 to 9, and more preferably the pH may be 8.20 at 70° F. The freezing temperature of the final diluted product 202 may be in the range of 15° F. to 25° F., and more preferably the freezing temperature is 18° F. Once blended with water, the final diluted product 202 is a homogeneous, stable fluid that requires only infrequent stirring. The final diluted product 202 is hydrated into a stable mixture in 20 minutes, without the use of special equipment.

EXAMPLES

Example 1

In Example 1, a dry concentrate is prepared containing the amounts of ingredients listed in Table 2 below. The values in Table 2 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 2

Dry Concentrate according to Example 1

| Ingredient | Ratio of Anhydrous to Hydrate | Weight Percent of Each Ingredient in Dry Concentrate |
|---|---|---|
| $MgCl_2$ Anhydrous | 36.4% | 32.7% |
| $MgCl_2 \cdot 6H_2O$ | 63.6% | 57.1% |
| Thickening agent 1-Polysaccharide gum | | 2.1% |
| Thickening agent 2-Chemically substituted cellulose | | 1.4% |
| Triethanolamine ($C_6H_{15}NO_3$) | | 1.3% |
| Colorant-Iron Oxide | | 0.66% |
| Dye | | 0.66% |
| Corrosion inhibitor | | 1.3% |
| SDS Surfactant | | 0.08% |
| Magnesium Hydroxide | | 0.73% |
| $TiO_2$ | | 0.66% |
| Mineral Oil | | 1.32% |
| Water | | 1.32% |
| Total Weight of Dry Concentrate | | 100% |

As seen in Table 2 above, the dry concentrate of Example 1 contains 1.32% water as a weight percent of the total weight of the dry concentrate. Preferably, the weight percent of water in the dry concentrate 101 is less than about 500, or less than about 400 or less than about 300 or less than about 200 relative to the total weight of the dry concentrate.

An Example 1 final diluted product 103 is prepared by mixing approximately 755 grams to about 770 grams, for example, 762.04 to 764.67 grams of the dry concentrate in 1 gallon of water. The amounts of the ingredients in the Example 1 final diluted product 103 are listed in Table 3 below. The values in Table 3 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%. The concentration of salt in the Example 1 final diluted product 103 is about 14% to 20% by weight in water, preferably about 15% to 19%, more preferably about 16% to 18%. For example, the weight percent of salt in the Example 1 final diluted product 103 is about 17%.

TABLE 3

Final Diluted Product according to Example 1

| Ingredient | Total grams/ Gallon | Grams per 5-gallon bucket added to 25 Gallons | Pounds per 5-gallon bucket added to 25 Gallons |
|---|---|---|---|
| $MgCl_2$ Anhydrous prior to addition of water | 250.255 | 6256.36 | 13.7930 |
| $MgCl_2 \cdot 6H_2O$ | 437.22 | 10930.58 | 24.0979 |
| Thickening agent 1-Polysaccharide gum | 14.67 | 366.85 | 0.8088 |
| Thickening agent 2-Chemically substituted cellulose | 9.33 | 233.19 | 0.5141 |
| Triethanolamine ($C_6H_{15}NO_3$) | 9.10 | 227.50 | 0.5016 |
| Colorant-Iron Oxide | 4.55 | 113.75 | 0.2508 |
| Dye | 4.55 | 113.75 | 0.2508 |
| Corrosion inhibitor | 9.10 | 227.50 | 0.5016 |
| SDS Surfactant | 0.555 | 13.88 | 0.0306 |
| Magnesium Hydroxide | 5.0051 | 125.13 | 0.2759 |
| $TiO_2$ | 4.5501 | 113.75 | 0.2508 |
| Mineral Oil | 4.401 | 110.11 | 0.2428 |
| Water | 9.10 | 227.50 | 0.5016 |
| Total Weight of Final Diluted Product | 4127.69 | | |
| Density of Final Diluted Product | 1.089 | | |

The density of the Example 1 final diluted product 103 at various temperatures is given in Table 4.

TABLE 4

Density of the final diluted product 103 at various temperatures

| Temperature (° F.) | Density (g/cm3) |
|---|---|
| 50 | 1.093 |
| 70 | 1.089 |
| 90 | 1.086 |

Figure 5A:
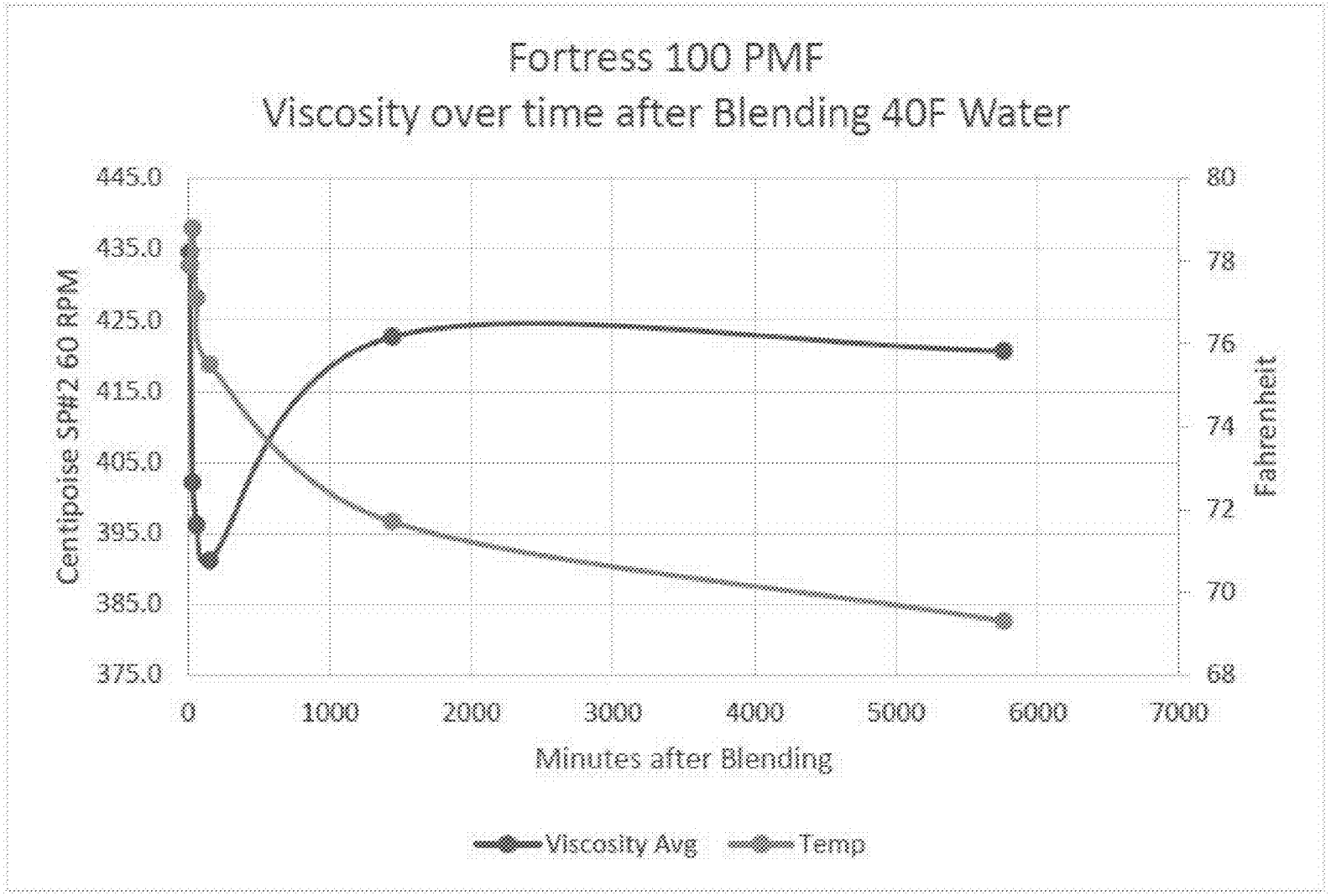
FIG. 5A is a graph showing the viscosity over time of Example 1 after blending with 40° F. water.

The viscosity over time of the Example 1 final diluted product 103 after blending with 40° F. water is given in Table 5. The results are also shown in FIG. 5A. The viscosity was measured using Brookfield rotational viscometer at 60 rpm. Spindle 2 was used for viscosity measurements between 1 and 500 centipoise and spindle 4 was used for viscosity measurements greater than 500 centipoise per USFS standards.

TABLE 5

Viscosity over time of the final diluted product 103 after blending with 40° F. water

| Viscosity Low | Viscosity High | Time (minutes) | Viscosity Avg | Temperature (° F.) |
|---|---|---|---|---|
| 434.4 | 434.9 | 10 | 434.7 | 77.9 |
| 401.9 | 402.4 | 30 | 402.2 | 78.8 |
| 395.9 | 396.4 | 60 | 396.2 | 77.1 |
| 390.9 | 391.4 | 150 | 391.2 | 75.5 |
| 422.4 | 422.9 | 1440 | 422.7 | 71.7 |
| 420.4 | 420.9 | 5760 | 420.7 | 69.3 |

Figure 5B:
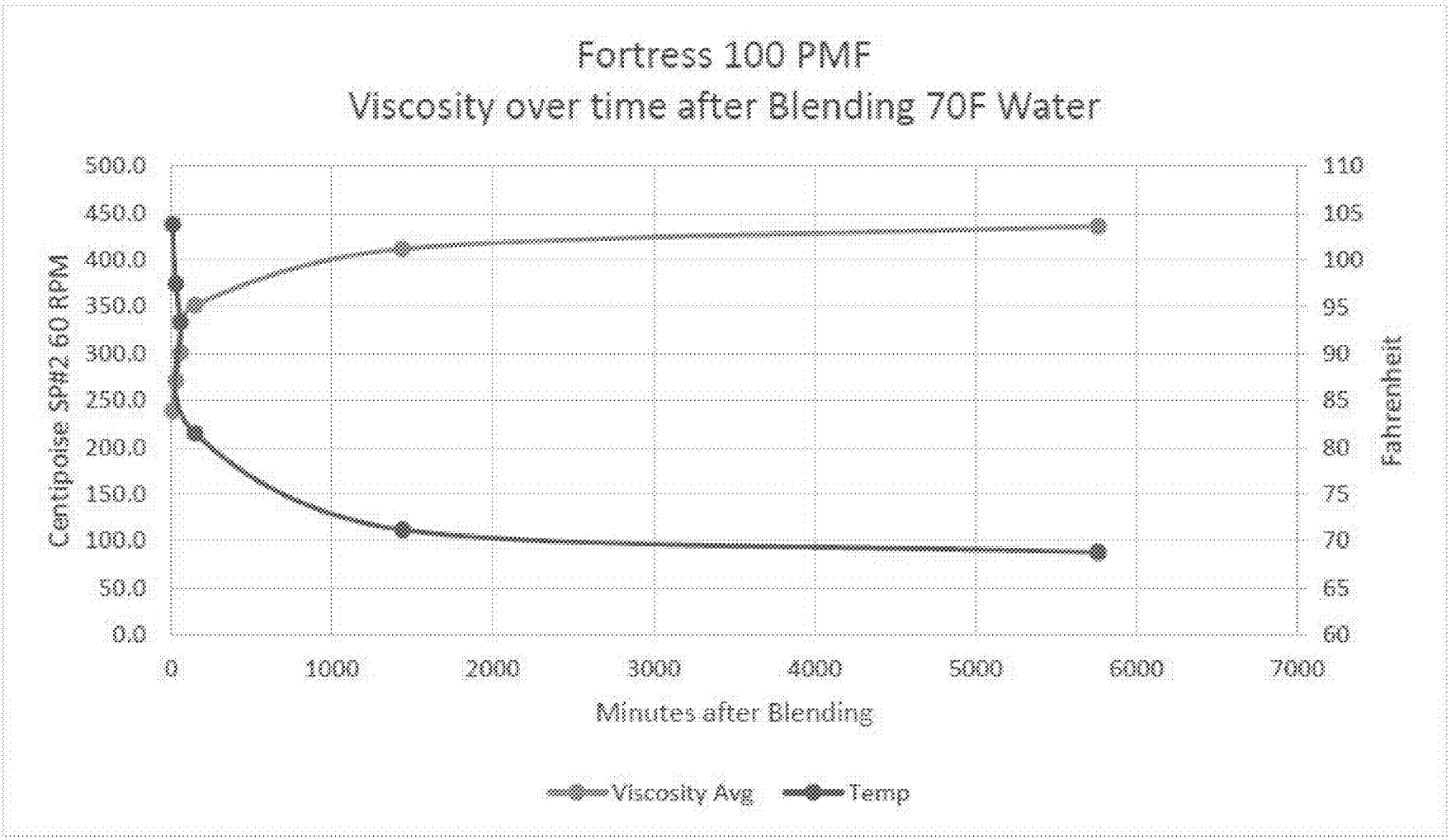
FIG. 5B is a graph showing the viscosity over time of Example 1 after blending with 70° F. water. After blending, the mixture was cooled naturally.

The viscosity over time of the Example 1 final diluted product 103 after blending with 70° F. water is given in Table 6. After blending, the mixture was allowed to cool naturally. The results are also shown in FIG. 5B.

TABLE 6

Viscosity over time of the final diluted product 103 after blending with 70° F. water

| Viscosity Low | Viscosity High | Time (minutes) | Viscosity Avg | Temperature (° F.) |
|---|---|---|---|---|
| 238.9 | 238.9 | 10 | 238.9 | 103.8 |
| 270.9 | 270.9 | 30 | 270.9 | 97.5 |
| 300.9 | 301.4 | 60 | 301.2 | 93.4 |
| 351.4 | 351.9 | 150 | 351.7 | 81.5 |
| 411.9 | 412.4 | 1440 | 412.2 | 71.2 |
| 435.9 | 436.9 | 5760 | 436.4 | 68.8 |

Figure 5C:
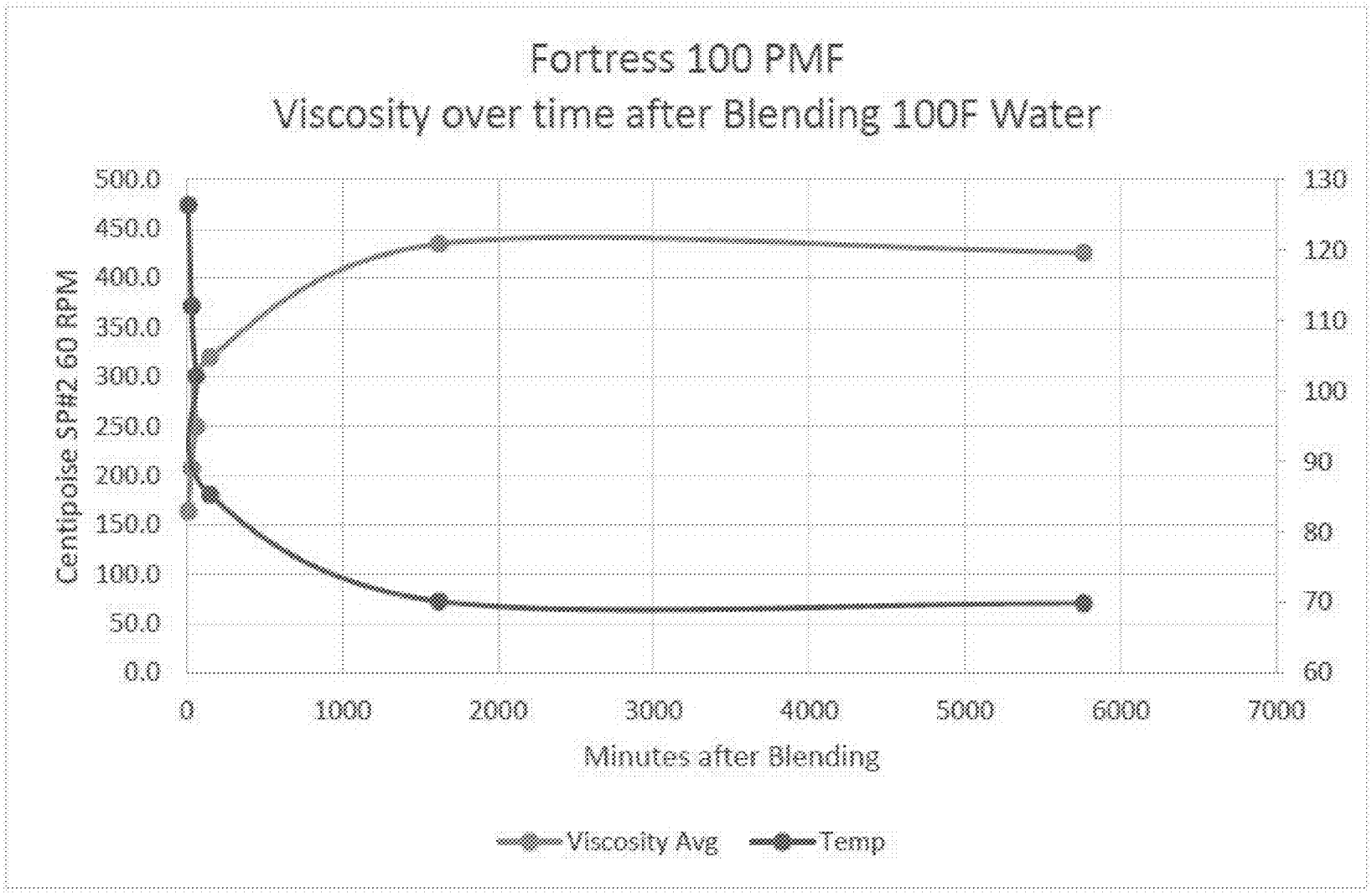
FIG. 5C is a graph showing the viscosity over time of Example 1 after blending with 100° F. water.

The viscosity over time of the Example 1 final diluted product 103 after blending with 100° F. water is given in Table 7. The results are also shown in FIG. 5C.

TABLE 7

Viscosity over time of the final diluted product 103 after blending with 100° F. water

| Viscosity Low | Viscosity High | Time (minutes) | Viscosity Avg | Temperature (° F.) |
|---|---|---|---|---|
| 164 | 164.5 | 10 | 164.3 | 126.4 |
| 207.5 | 208 | 30 | 207.8 | 112.1 |
| 249.4 | 249.9 | 60 | 249.7 | 102.1 |
| 319.9 | 320.4 | 150 | 320.2 | 85.3 |
| 434.9 | 434.9 | 1620 | 434.9 | 70.2 |
| 425.9 | 426.4 | 5760 | 426.2 | 69.9 |

Figure 5D:
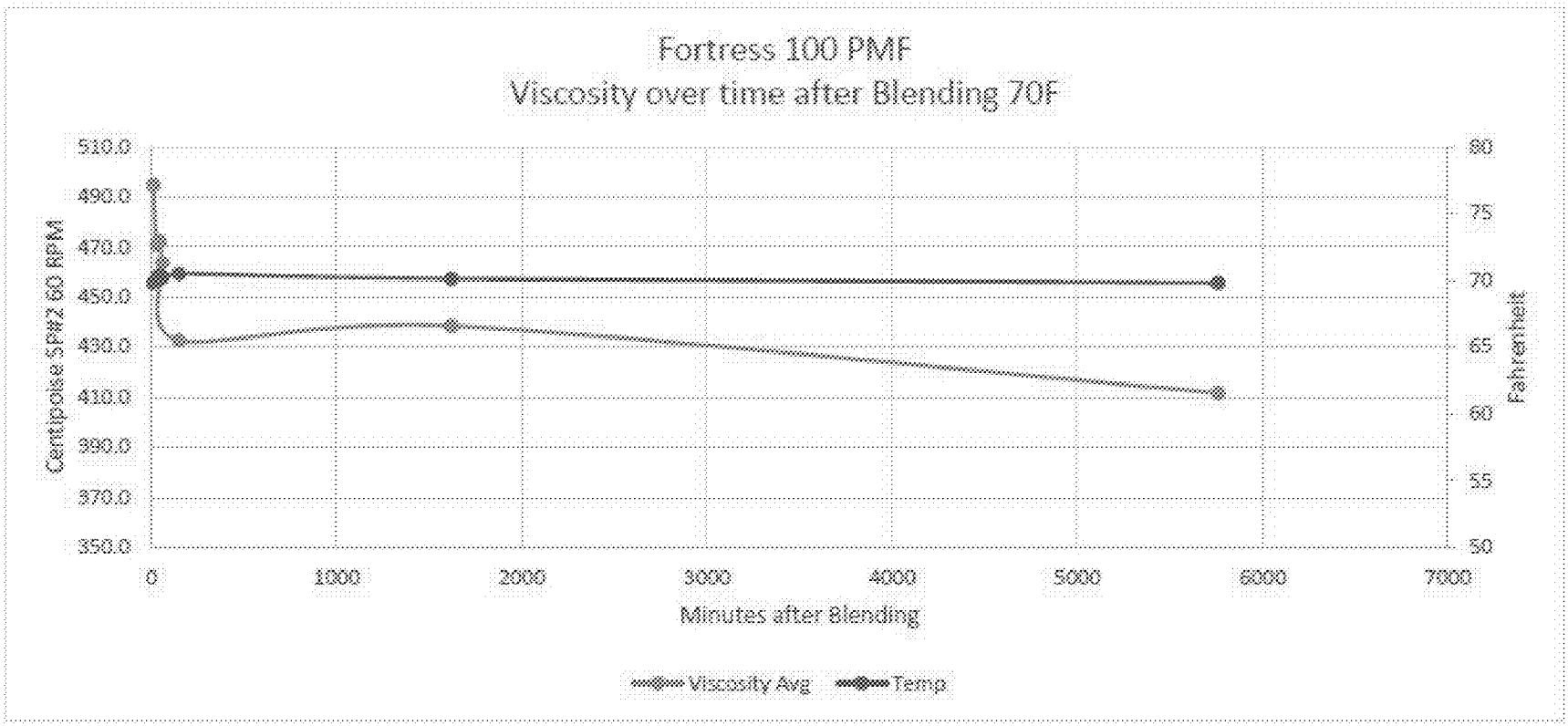
FIG. 5D is a graph showing the viscosity over time of Example 1 at 70° F. After blending, the mixture was cooled in an ice bath to 70° F. and maintained at 70° F.

The viscosity over time of the Example 1 final diluted product 103 after blending with 70° F. water is given in Table 8. After blending, the mixture was cooled in an ice bath to 70° F. and maintained at 70° F. The results are also shown in FIG. 5D.

TABLE 8

Viscosity over time of the final diluted product 103 after blending with 40° F. water

| Viscosity Low | Viscosity High | Time (minutes) | Viscosity Avg | Temperature (° F.) |
|---|---|---|---|---|
| 494.4 | 494.9 | 10 | 494.7 | 69.8 |
| 466.9 | 474.9 | 30 | 470.9 | 70.2 |
| 471.9 | 472.4 | 45 | 472.2 | 70.4 |
| 463.4 | 463.9 | 60 | 463.7 | 70.2 |
| 432.4 | 432.9 | 150 | 432.7 | 70.5 |
| 438.4 | 438.5 | 1620 | 438.5 | 70.1 |
| 411.4 | 411.9 | 5760 | 411.7 | 69.8 |

The viscosity at 1 hour and 24 hours after mixing a 125% concentration of Example 1 final diluted product 103 with 70° F. water is given in Table 9. To prepare the 125% concentration above the target concentration of the Example 1 final diluted product 103, about 993.5 grams of the dry concentrate were mixed in 1 gallon of water to obtain a concentration 25% above the target concentration.

TABLE 9

Viscosity of 125% final diluted product 103

| Viscosity Low | Viscosity High | Time (Hours) | Viscosity Avg (cP) | Temperature (° F.) |
|---|---|---|---|---|
| 1250 | 1260 | 1 | 1255 | 69 |
| 1160 | 1170 | 24 | 1165 | 70.4 |

The viscosity at 1 hour and 24 hours after mixing a 150% concentration of Example 1 final diluted product 103 with 70° F. water is given in Table 10. To prepare the 150% concentration above the target concentration of the Example 1 final diluted product 103, about 1258.1 grams of the dry concentrate were mixed in 1 gallon of water to obtain a concentration 50% above the target concentration.

TABLE 10

Viscosity of 150% final diluted product 103

| Viscosity Low | Viscosity High | Time (Hours) | Viscosity Avg (cP) | Temperature (° F.) |
|---|---|---|---|---|
| 2260 | 2270 | 1 | 2265 | 70.4 |
| 2210 | 2220 | 24 | 2215 | 70.3 |

The viscosity at 1 hour and 24 hours after mixing a 75% concentration of Example 1 final diluted product 103 with 70° F. water is given in Table 11. To prepare the 75% concentration below the target concentration of the Example 1 final diluted product 103, about 539.3 grams of the dry concentrate were mixed in 1 gallon of water to obtain a concentration of 25% below the target concentration.

TABLE 11

Viscosity of 75% final diluted product 103

| Viscosity Low | Viscosity High | Time (Hours) | Viscosity Avg (cP) | Temperature (° F.) |
|---|---|---|---|---|
| 167.5 | 168.0 | 1.0 | 167.8 | 70.0 |
| 154.0 | 154.5 | 24.0 | 154.3 | 70.1 |

Figure 6:
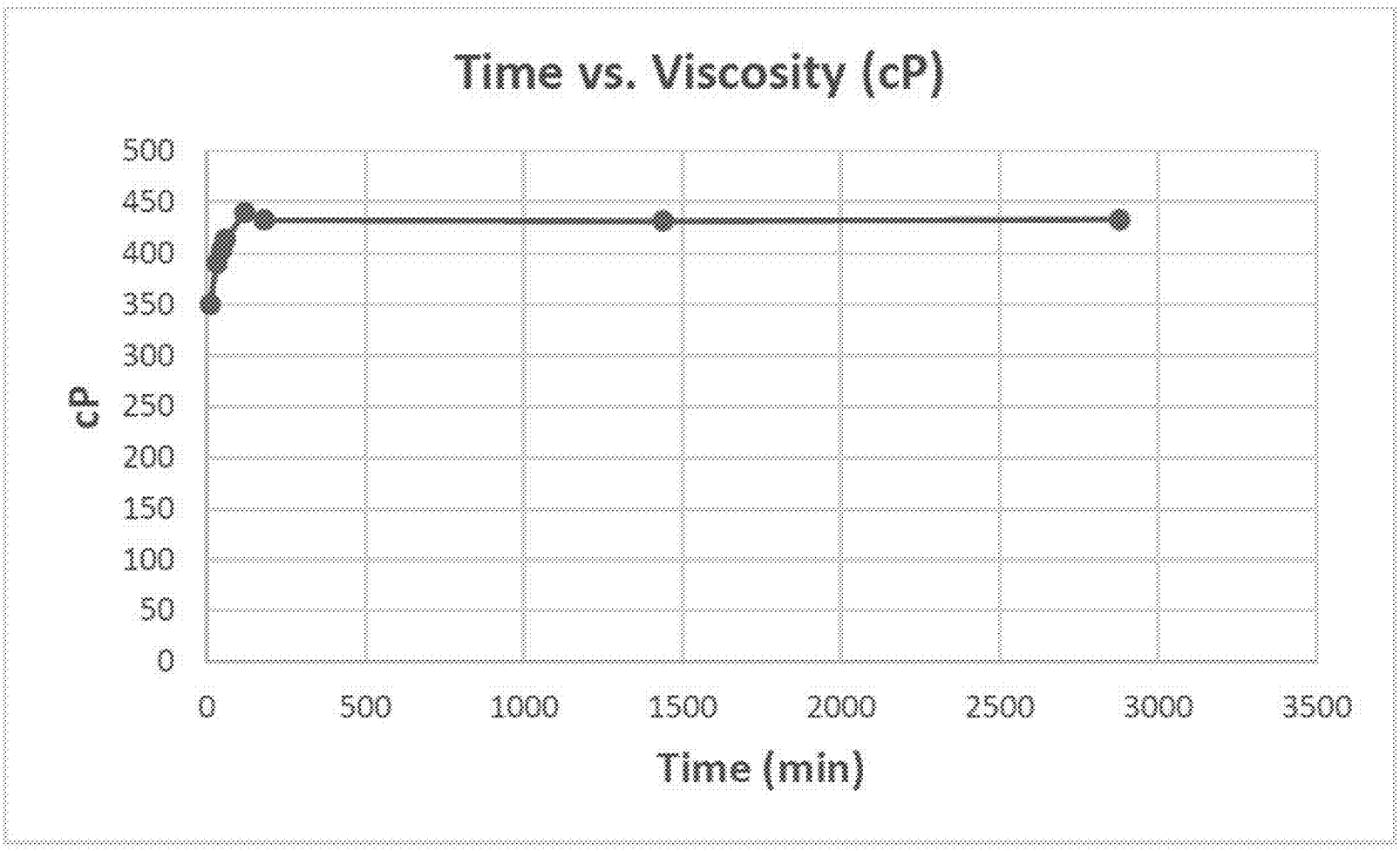
FIG. 6 is a graph showing the viscosity of Example 1 versus time after mixing at 70° F.

The forest fire retardant composition of Example 1 is a thixotropic mixture and has a time-dependent shear thinning property. The viscosity after the forest fire retardant composition of Example 1 was measured after the mixture was allowed to stand for more than a few hours. The mixtures were stirred with an overhead stirrer for 3 minutes adjusting the temperature of the liquid to 70° F. or as close to that temperature as possible, and then the mixture was allowed to stand for 5 minutes. The viscometer spindle was lowered into the mixture and the spindle was started (Spindle 2, 60 RPM). Viscosity measurements (and temperature measurements) were taken at 1 minute, 2 minutes, and 3 minutes after the spindle was started. The measurement that was taken at 1 minute was reported as the viscosity. Table 12 shows mixed retardant viscosity values, at a temperature of 70° F., versus time after mixing. The results are also shown in FIG. 6. The solid mixture was added to tap water at 58.8° F. over a period of about 1 minute while cooling in an ice bath. The maximum temperature was 95.2° F. The mixture was stirred for a total of 1 hour.

TABLE 12

| Viscosity of final diluted product 103 versus time after mixing | | |
|---|---|---|
| Time (min) | Viscosity (cP) | Temperature (° F.) |
| 12 | 349.9 | 70.0 |
| 31 | 390.4 | 70.0 |
| 46 | 402.9 | 70.0 |
| 60 | 413.4 | 69.9 |
| 120 | 440.4 | 69.9 |
| 180 | 432.4 | 69.9 |
| 1440 | 431.4 | 70.0 |
| 2880 | 432.9 | 70.0 |

Table 13 shows the viscosity of forest fire retardant composition of Example 1 versus mixing with 40° F. water. The mixture was stirred for a total of 1 hour. The initial water temperature was 40° F. and the maximum water temperature was 78.3° F.

TABLE 13

| Viscosity of final diluted product 103 versus time after mixing with 40° F. water | | |
|---|---|---|
| Time (min) | Viscosity (cP) | Temperature (° F.) |
| 10 | 290.9 | 77.5 |
| 30 | 374.9 | 76.1 |
| 60 | 414.4 | 74.5 |
| 180 | 439.9 | 73.3 |
| 1440 | 461.9 | 69.6 |

Table 14 shows the viscosity of forest fire retardant composition of Example 1 versus mixing with 70° F. water. The mixture was stirred for a total of 1 hour. The initial water temperature was 70° F. and the maximum water temperature was 107.7° F.

TABLE 14

| Viscosity of final diluted product 103 versus time after mixing with 70° F. water | | |
|---|---|---|
| Time (min) | Viscosity (cP) | Temperature (° F.) |
| 10 | 308.4 | 103.3 |
| 30 | 407.4 | 95.8 |
| 60 | 428.4 | 88.3 |
| 120 | 456.4 | 85.0c |
| 180 | 438.4 | 79.2 |
| 1440 | 460.4 | 70.2 |

Table 15 shows the viscosity of forest fire retardant composition of Example 1 versus mixing with 99° F. water. The mixture was stirred for a total of 1 hour. The initial water temperature was 99° F. and the maximum water temperature was 134.6° F.

TABLE 15

| Viscosity of final diluted product 103 versus time after mixing with 99° F. water | | |
|---|---|---|
| Time (min) | Viscosity (cP) | Temperature (° F.) |
| 10 | 345.9 | 122.8 |
| 30 | 394.4 | 108.0 |
| 60 | 412.9 | 94.2 |
| 180 | 442.9 | 82.1 |
| 1440 | 461.4 | 69.8 |

Table 16 shows mixed retardant viscosity of Example 1 at 70° F., 1 hour and 24 hours following mixing versus mix ratio. The results are shown for 0.25, 0.5, 0.75 percent below the target mix ratio and 0.25, 0.5, and 0.75 percent above the target mix ratio of the forest fire retardant composition of Example 1. The starting water temperature for mixing was 70° F. The mixtures were stirred at ambient temperature for 20 minutes then cooled in a cold water bath until the temperature of the mixture was about 70° F. The mixtures were then stirred for an hour.

TABLE 16

| Viscosity versus mix ratio of the final diluted product 103 | | | |
|---|---|---|---|
| Concentration | Time (Hours) | Viscosity (cP) | Temperature (° F.) |
| normal | 1 | 448.9 | 70.2 |
| normal | 24 | 458.4 | 70.0 |
| 0.50% below normal | 1 | 463.9 | 70.3 |
| 0.50% below normal | 24 | 455.9 | 69.7 |
| 0.75% below normal | 1 | 458.9 | 69.9 |
| 0.75% below normal | 24 | 450.4 | 69.7 |
| 0.50% above normal | 1 | 453.9 | 70.2 |
| 0.50% above normal | 24 | 455.9 | 70.5 |
| 0.75% above normal | 1 | 448.4 | 70.1 |
| 0.75% above normal | 24 | 457.4 | 69.7 |

Example 2

In Example 2, a dry concentrate 101 is prepared containing the amounts of ingredients listed in Table 17 below. The values in Table 17 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 17

| Dry Concentrate according to Example 2 | |
|---|---|
| Ingredient | Weight Percent of Each Ingredient in Dry Concentrate |
| MgO | 32.10% |
| $Mg(OH)_2$ | 57.10% |
| Thickening agent 1 - Polysaccharide gum | 2.10% |
| Thickening agent 2 - Chemically substituted cellulose | 1.40% |
| Triethanolamine ($C_6H_{15}NO_3$) | 1.30% |
| Colorant - Iron Oxide | 0.66% |
| Dye | 0.66% |
| Corrosion inhibitor | 1.30% |
| SDS Surfactant | 0.08% |
| $TiO_2$ | 0.66% |
| Mineral Oil | 1.32% |
| Water | 1.32% |
| Total Weight of Dry Concentrate | 100% |

In Example 2, a final diluted product 103 is prepared by mixing the dry concentrate 101 with water in a weight ratio concentrate:water of about 1:4. In Example 2, approximately 1 pounds of the dry concentrate 101 is mixed with 4 pounds of water to prepare the final diluted product 103. Alternatively, the final diluted product 202 can be prepared by mixing the liquid concentrate 201 with water in a volume ratio concentrate:water of about 1.0:1.0 to about 1.0:5.0.

In Example 2, the amounts of the ingredients in the final diluted product 103 are listed in Table 18 below. The values in Table 18 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 18

| Final Product according to Example 2 | |
|---|---|
| Ingredient | Weight Percent of Each Ingredient in Final Diluted Product |
| MgO prior to addition of water | 6.42% |
| $Mg(OH)_2$ | 11.42% |
| Thickening agent 1 - Polysaccharide gum | 0.42% |
| Thickening agent 2 - Chemically substituted cellulose | 0.28% |
| Triethanolamine ($C_6H_{15}NO_3$) | 0.26% |
| Colorant - Iron Oxide | 0.13% |
| Dye | 0.13% |
| Corrosion inhibitor | 0.26% |
| SDS Surfactant | 0.02% |
| $TiO_2$ | 0.13% |
| Mineral Oil | 0.26% |
| Water | 80.26% |
| Total Weight of Final Product | 100% |

In the final diluted product 103 of Example 2, the weight percent of metal oxide prior to addition of water is about 0.5% to about 70%, preferably about 1% to about 40%, more preferably about 2% to about 20%. For example, the weight percent of metal oxide in final diluted product 103 of Example 2 is about 3% to about 15%, and specifically about 6%±0.5%.

In the final diluted product 103 of Example 2, the weight percent of metal hydroxide is about 1% to about 50%, preferably about 2% to about 40%, more preferably about 3% to about 30%. For example, the weight percent of metal hydroxide in final diluted product 103 of Example 2 is about 5% to about 20%, and specifically about 11%±1.0%.

Example 3

In Example 3, a liquid concentrate is prepared containing the amounts of ingredients listed in Table 19 below. The values in Table 19 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 19

| Liquid Concentrate according to Example 3 | |
|---|---|
| Ingredient | Weight Percent of Each Ingredient in Liquid Concentrate |
| 30% $MgCl_2$ Solution | 96.46% |
| Thickening agent 1 - Polysaccharide gum | 0.69% |
| Colorant - Iron Oxide Black | 0.84% |
| Magnesium Hydroxide | 0.32% |
| $TiO_2$ | 0.28% |
| Triethanolamine ($C_6H_{15}NO_3$) | 0.58% |
| Corrosion inhibitor | 0.58% |
| Dye | 0.21% |
| SDS Surfactant | 0.04% |
| Total Weight of Liquid Concentrate | 100% |

The density of the liquid concentrate 201 of Example 3 at various temperatures is given in Table 20.

TABLE 20

| Density of the liquid concentrate 201 at various temperatures | |
|---|---|
| Temperature (° F.) | Density (g/cm3) |
| 50 | 1.261 |
| 70 | 1.279 |
| 90 | 1.258 |

A final diluted product 202 of Example 3 is prepared by mixing 4.405 pounds of the liquid concentrate 201 with 1 gallon of water or 0.41 gallons of the liquid concentrate 201 with 1 gallon of water. The ratio of liquid concentrate:water is about 1.00:1.5 to about 1.00:2.5, for example, 1.00:1.895 to 1.00:2.43. The amounts of the ingredients in the final diluted product are listed in Table 21 below. The values in Table 21 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%. The concentration of Example 3 is about 40% to 65% by weight in water, preferably about 45% to 60%, more preferably about 48% to 55%. For example, the concentration of Example 3 is about 53%. In Example 3, the weight percent of the liquid concentrate 201 relative to the total weight of the final diluted product 202 may be about 20% to about 50%, or about 25% to about 45%, or about 30% to about 40%, or about 35%±2%.

TABLE 21

| Final Diluted Product according to Example 3 | | |
|---|---|---|
| Ingredient | Total grams/gallon | Total pounds/gallon |
| 30% $MgCl_2$ Solution | 1376.6281 | 3.0349 |
| Thickening agent 1 - Polysaccharide gum | 9.4987 | 0.0209 |
| Colorant - Iron Oxide Black | 11.9891 | 0.0264 |
| Magnesium Hydroxide | 4.5429 | 0.0100 |
| $TiO_2$ | 4.0266 | 0.0089 |
| Triethanolamine ($C_6H_{15}NO_3$) | 8.2598 | 0.0182 |
| Corrosion inhibitor | 8.2598 | 0.0182 |
| Dye | 2.9983 | 0.0066 |
| SDS Surfactant | 0.5038 | 0.0011 |
| Water | 2703.1772 | 5.9595 |
| Total Weight of Final Diluted Product | 4129.8843 | 9.1048 |
| Density of Final Diluted Product | 1.091 | 9.1050 |

The density of the final diluted product 202 of Example 3 at various temperatures is given in Table 22.

TABLE 22

| Density of the final diluted product 202 at various temperatures | |
|---|---|
| Temperature (° F.) | Density (g/cm3) |
| 50 | 1.094 |
| 70 | 1.091 |
| 90 | 1.088 |

Figure 7:
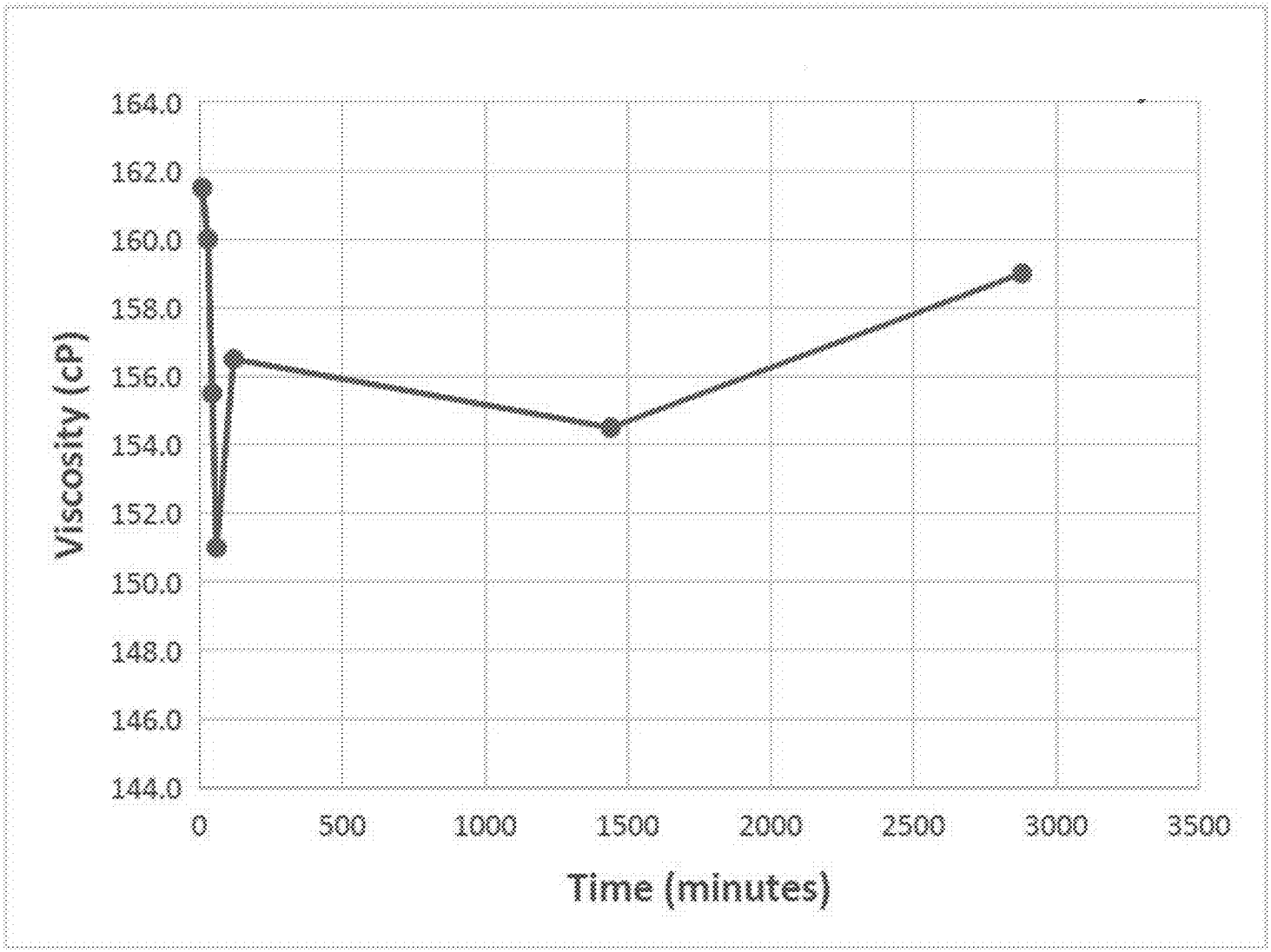
FIG. 7 is a graph showing the viscosity over time of Example 3 after blending with 70° F. water.

The viscosity over time of the final diluted product 202 of Example 3 after blending with 70° F. water is given in Table 23. The results are also shown in FIG. 7. The viscosity was measured using Brookfield rotational viscometer at 60 rpm. Spindle 2 was used for viscosity measurements between 1 and 500 centipoise and spindle 4 was used for viscosity measurements greater than 500 centipoise per USFS standards.

TABLE 23

| Viscosity over time of the final diluted product 202 after blending with 70° F. water | | |
|---|---|---|
| Time (minutes) | Viscosity (cP) | Temperature (° F.) |
| 10 | 161.5 | 70.0 |
| 30 | 160.0 | 70.2 |
| 45 | 155.5 | 70.2 |
| 60 | 151.0 | 70.0 |
| 120 | 156.5 | 70.3 |
| 150 | 391.2 | 75.5 |
| 1440 | 154.5 | 70.3 |
| 2880 | 159.0 | 70.2 |

Figure 8:
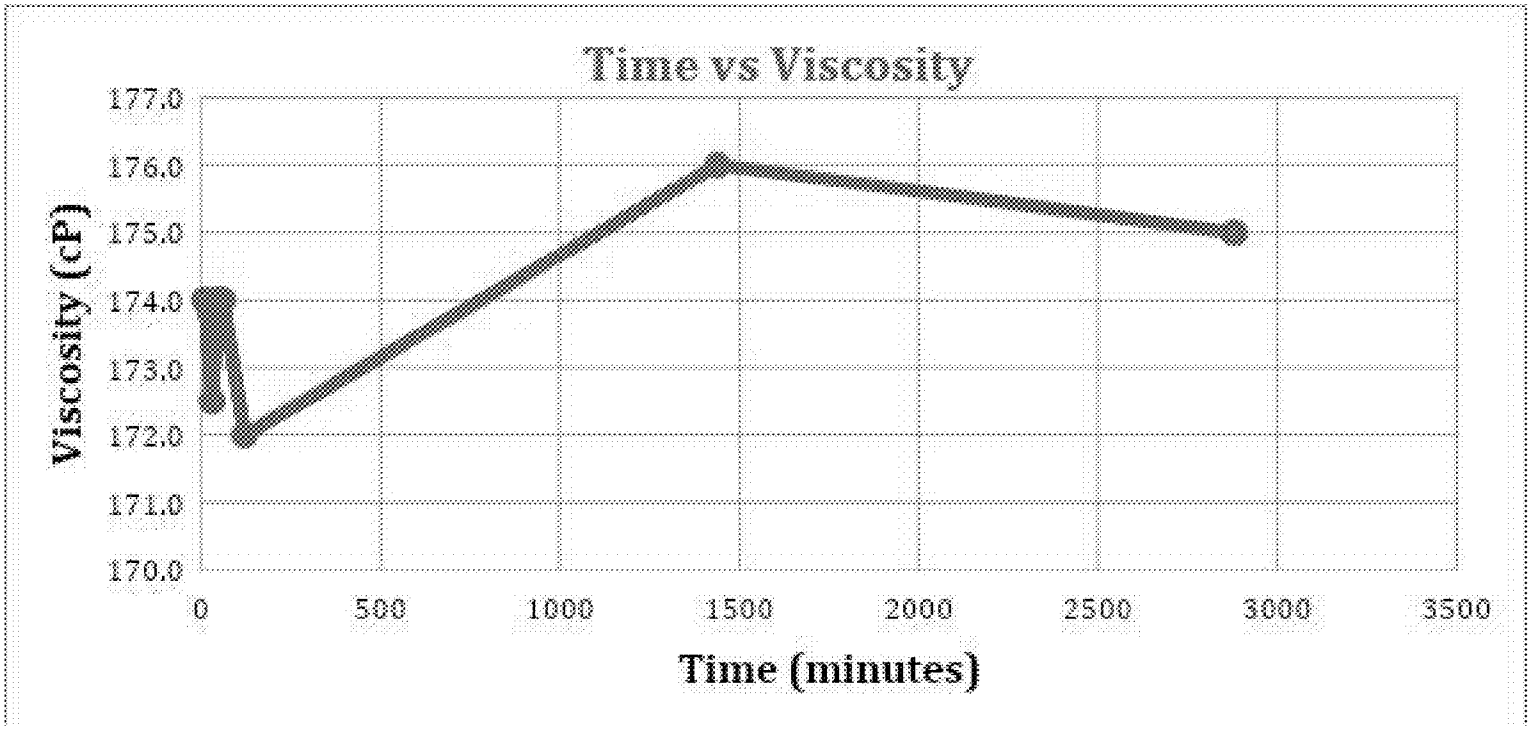
FIG. 8 is a graph showing the viscosity of the final diluted product of Example 3 maintained at 70° F.

The viscosity over time of the final diluted product 202 of Example 3 maintained at 70° F. water is given in Table 24. The results are also shown in FIG. 8.

TABLE 24

| Viscosity over time of the final diluted product 202 maintained at 70° F. | | | | |
|---|---|---|---|---|
| % Torque | Time (minutes) | Viscosity (cP) | Temperature (° F.) | Temperature (° C.) |
| 34.8 | 10 | 174.0 | 69.8 | 21.0 |
| 34.6 | 30 | 172.5 | 71.5 | 22.0 |
| 34.8 | 45 | 174.0 | 70.3 | 21.3 |
| 34.8 | 60 | 174.0 | 69.0 | 20.8 |
| 34.4 | 120 | 172.0 | 69.0 | 20.8 |
| 35.1 | 1440 | 176.0 | 69.2 | 20.7 |
| 35.0 | 2880 | 175.0 | 70.1 | 21.2 |

The viscosity over time of the final diluted product 202 of Example 3 after blending with 40° F. water is given in Table 25.

TABLE 25

| Viscosity over time of the final diluted product 202 after blending with 40° F. water | | |
|---|---|---|
| Time (minutes) | Viscosity (cP) | Temperature (° F.) |
| 10 | 185.0 | 57.2 |
| 30 | 178.0 | 60.0 |
| 60 | 175.0 | 62.2 |
| 120 | 168.0 | 64.5 |
| 1440 | 171.0 | 69.6 |
| 2880 | 176.0 | 65.8 |

The viscosity over time of the final diluted product 202 of Example 3 after blending with 70° F. water is given in Table 26.

TABLE 26

| Viscosity over time of the final diluted product 202 after blending with 70° F. water | | |
|---|---|---|
| Time (minutes) | Viscosity (cP) | Temperature (° F.) |
| 10 | 168.0 | 73.5 |
| 30 | 169.0 | 71.6 |
| 60 | 171.0 | 70.3 |
| 120 | 168.0 | 69.8 |
| 1440 | 172.0 | 68.3 |
| 2880 | 172.0 | 70.3 |

The viscosity over time of the final diluted product 202 of Example 3 after blending with 100° F. water is given in Table 27.

TABLE 27

| Viscosity over time of the final diluted product 202 after blending with 100° F. water | | |
|---|---|---|
| Time (minutes) | Viscosity (cP) | Temperature (° F.) |
| 10 | 157.0 | 84.0 |
| 30 | 159.0 | 82.0 |
| 60 | 160.0 | 78.6 |
| 120 | 161.0 | 73.9 |
| 1440 | 172.0 | 68.7 |
| 2880 | 174.0 | 68.0 |

The viscosity at 1 hour and 24 hours after mixing varying mix ratios of the final diluted product 202 of Example 3 with 70° F. water is given in Table 28. The measurements taken with spindle 62 at 60 RPM and 1 minute after the spindle is started. The concentrations were dissolved in tap water (378.94 g) at 69.5° F. The results are shown for 0.25, 0.5, 0.75 percent below the target mix ratio and 0.25, 0.5, and 0.75 percent above the target mix ratio of the forest fire retardant composition of Example 3. The starting water temperature for mixing was 70° F. The amount of liquid concentrate 201 used to prepare concentration is given in Table 28.

TABLE 28

| Viscosity of final diluted product 202 versus the mix ratio | | | | |
|---|---|---|---|---|
| Amount of Liquid Concentrate (g) | Percent Difference from Target Mix Ratio | Temperature (° F.) | Time (Hours) | Viscosity (cP) |
| 197.16 | −0.75% | 70.1 | 1 | 168.0 |
| 197.16 | −0.75% | 69.8 | 24 | 172.0 |
| 198.11 | −0.50% | 70.1 | 1 | 170.0 |
| 198.11 | −0.50% | 69.6 | 24 | 174.0 |
| 199.06 | −0.25% | 70.3 | 1 | 171.0 |
| 199.06 | −0.25% | 70.1 | 24 | 173.0 |
| 200.00 | 0.00% | 70.5 | 1 | 171.5 |
| 200.00 | 0.00% | 69.2 | 24 | 174.0 |
| 200.95 | 0.25% | 69.8 | 1 | 173.0 |
| 200.95 | 0.25% | 69.8 | 24 | 173.0 |
| 201.90 | 0.50% | 69.5 | 1 | 176.0 |
| 201.90 | 0.50% | 69.6 | 24 | 177.0 |
| 202.85 | 0.75% | 69.4 | 1 | 177.0 |
| 202.85 | 0.75% | 69.8 | 24 | 179.0 |

The forest fire retardant composition of Example 3 is a thixotropic mixture and has a time-dependent shear thinning property.

Example 4

In Example 4, a liquid concentrate 201 is prepared containing the amounts of ingredients listed in Table 29 below. The values in Table 29 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 29

| Liquid Concentrate according to Example 4 | |
|---|---|
| Ingredient | Weight Percent of Each Ingredient in Liquid Concentrate |
| 30% $Mg(OH)_2$ Solution | 96.78% |
| Thickening agent 1 - Polysaccharide gum | 0.69% |
| Colorant - Iron Oxide Black | 0.84% |

TABLE 29-continued

| Liquid Concentrate according to Example 4 | |
|---|---|
| Ingredient | Weight Percent of Each Ingredient in Liquid Concentrate |
| $TiO_2$ | 0.28% |
| Triethanolamine ($C_6H_{15}NO_3$) | 0.58% |
| Corrosion inhibitor | 0.58% |
| Dye | 0.21% |
| SDS Surfactant | 0.04% |
| Total Weight of Liquid Concentrate | 100% |

In Example 4, a final diluted product 202 is prepared by mixing the liquid concentrate 201 with water in a weight ratio concentrate:water of about 1:1.895. In Example 4, approximately 1 pound of the liquid concentrate 201 is mixed with 1.895 pounds of water to prepare the Example 4 final diluted product 202. Alternatively, the final diluted product 202 can be prepared by mixing the liquid concentrate 201 with water in a volume ratio concentrate:water of about 1.0:0.5 to about 1.0:3.0.

In Example 4, the amounts of the ingredients in the final diluted product 202 are listed in Table 30 below. The values in Table 30 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 30

| Final Diluted Product according to Example 4 | |
|---|---|
| Ingredient | Weight Percent of Each Ingredient in Final Diluted Product |
| 30% $Mg(OH)_2$ Solution | 33.43% |
| Thickening agent 1 - Polysaccharide gum | 0.24% |
| Colorant - Iron Oxide Black | 0.29% |
| $TiO_2$ | 0.10% |
| Triethanolamine ($C_6H_{16}NO_3$) | 0.20% |
| Corrosion inhibitor | 0.20% |
| Dye | 0.07% |
| SDS Surfactant | 0.01% |
| Water | 65.46% |
| Total Weight of Liquid Concentrate | 100% |

In the final diluted product 202 of Example 4, the weight percent of metal hydroxide is about 1% to about 50%, preferably about 2% to about 40%, more preferably about 3% to about 30%. For example, the weight percent of metal hydroxide in final diluted product 202 is about 5% to about 20%, and specifically about 10%±1.0%.

Example 5

In Example 5, a liquid concentrate 201 is prepared containing the amounts of ingredients listed in Table 31 below. The values in Table 31 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 31

| Liquid Concentrate according to Example 5 | |
|---|---|
| Ingredient | Weight Percent of Each Ingredient in Liquid Concentrate |
| 30% Corrosion Inhibited $MgCl_2$ Solution | 99.19% |
| Thickening agent | 0.20% |
| Colorant | 0.00% |
| Magnesium Hydroxide | 0.20% |
| Adjuvants | 0.20% |
| Corrosion inhibitor | 0.00% |
| Dye | 0.21% |
| Water | 0.00% |
| Total Weight of Liquid Concentrate | 100% |

In Example 5, a final diluted product 202 is prepared by mixing the liquid concentrate 201 with water in a weight ratio concentrate:water of about 1:1. In Example 5, approximately 1 pound of the liquid concentrate 201 is mixed with 1 pound of water to prepare the Example 5 final diluted product 202. Alternatively, the final diluted product 202 can be prepared by mixing the liquid concentrate 201 with water in a volume ratio concentrate:water of about 1.0:0.25 to about 1.0:3.0.

In Example 5, the amounts of the ingredients in the final diluted product 202 are listed in Table 32 below. The values in Table 32 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 32

| Final Diluted Product according to Example 5 | |
|---|---|
| Ingredient | Weight Percent of Each Ingredient in Final Diluted Product |
| 30% Corrosion Inhibited $MgCl_2$ Solution | 49.60% |
| Thickening agent | 0.10% |
| Colorant | 0.00% |
| Magnesium Hydroxide | 0.10% |
| Adjuvants | 0.10% |
| Corrosion inhibitor | 0.00% |
| Dye | 0.11% |
| Water | 50.00% |
| Total Weight of Final Diluted Product | 100% |

In the final diluted product 202 of Example 5, the weight percent of magnesium chloride is about 4% to about 30%, preferably about 6% to about 25%, more preferably about 8% to about 20%. For example, the weight percent of magnesium chloride in final diluted product 202 is about 12% to about 18%, and specifically about 15%±1.0%.

The weight percent of adjuvants, relative to the amount of the retardant compound in the final diluted product 202 of Example 5, is about 0.005% to about 2%, preferably about 0.0075% to about 1.75%, more preferably about 0.01% to about 1.5%, and more specifically about 0.025% to about 1.25%. For example, the weight percent of adjuvants, relative to the amount of the retardant compound in the final diluted product 202 of Example 5, is about 0.05% to about 1.0%, and specifically about 0.67%±0.1%.

The fugitive dye will impart a visible tint to the forest fire retardant of Example 5 that will disappear with exposure to sunlight. The forest fire retardant composition of Example 5 is thickened with a thickening agent to increase spraying effectiveness, adhesion to fuel, and an increased surface tension over water. The viscosity of the final diluted product 202 of Example 5 may be in the range of 20-200 cPs, for example 50-100 cPs.

Example 6

In Example 6, a liquid concentrate 201 is prepared containing the amounts of ingredients listed in Table 33 below. The values in Table 33 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 33

Liquid Concentrate according to Example 6

| Ingredient | Weight Percent of Each Ingredient in Liquid Concentrate |
|---|---|
| 30% Non-corrosion Inhibited $MgCl_2$ Solution | 98.40% |
| Thickening agent | 0.30% |
| Colorant | 0.00% |
| Magnesium Hydroxide | 0.32% |
| Adjuvants | 0.58% |
| Corrosion inhibitor | 0.20% |
| Dye | 0.20% |
| Water | 0.00% |
| Total Weight of Liquid Concentrate | 100% |

In Example 6, a final diluted product 202 is prepared by mixing the liquid concentrate 201 with water in a weight ratio concentrate:water of about 1:2. In Example 6, approximately 1 pound of the liquid concentrate 201 is mixed with 2 pounds of water to prepare the Example 6 final diluted product 202. Alternatively, the final diluted product 202 can be prepared by mixing the liquid concentrate 201 with water in a volume ratio concentrate:water of about 1.0:0.5 to about 1.0:3.0.

In Example 6, the amounts of the ingredients in the final diluted product 202 are listed in Table 34 below. The values in Table 34 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 34

Final Diluted Product according to Example 6

| Ingredient | Weight Percent of Each Ingredient in Final Diluted Product |
|---|---|
| 30% Non-corrosion Inhibited $MgCl_2$ Solution | 32.80% |
| Thickening agent | 0.10% |
| Colorant | 0.00% |
| Magnesium Hydroxide | 0.11% |
| Adjuvants | 0.19% |
| Corrosion inhibitor | 0.07% |
| Dye | 0.07% |
| Water | 66.67% |
| Total Weight of Final Diluted Product | 100% |

In the final diluted product 202 of Example 6, the weight percent of magnesium chloride is about 2% to about 20%, preferably about 3% to about 18%, more preferably about 4% to about 16%. For example, the weight percent of magnesium chloride in final diluted product 202 is about 5% to about 14%, and specifically about 10%±1.0%.

The weight percent of adjuvants, relative to the amount of the retardant compound in the final diluted product 202 of Example 6, is about 0.1% to about 3.0%, preferably about 0.2% to about 2.8%, more preferably about 0.3% to about 2.6%, and more specifically about 0.4% to about 2.4%. For example, the weight percent of adjuvants, relative to the amount of the retardant compound in the final diluted product 202 of Example 6, is about 0.5% to about 2.2%, and specifically about 1.9%±0.1%.

The fugitive dye will impart a visible tint to the forest fire retardant of Example 6 that will disappear with exposure to sunlight. The forest fire retardant composition of Example 6 is thickened with a thickening agent to increase spraying effectiveness, adhesion to fuel, and an increased surface tension over water. The viscosity of the final diluted product 202 of Example 6 may be in the range of 20-200 cPs, for example 50-100 cPs.

Example 7

In Example 7, a liquid concentrate 201 is prepared containing the amounts of ingredients listed in Table 35 below. The values in Table 35 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 35

Liquid Concentrate according to Example 7

| Ingredient | Weight Percent of Each Ingredient in Liquid Concentrate |
|---|---|
| 30% Corrosion Inhibited $MgCl_2$ Solution | 98.99% |
| Thickening agent | 0.20% |
| Pigment | 0.20% |
| Magnesium Hydroxide | 0.20% |
| Adjuvants | 0.20% |
| Corrosion inhibitor | 0.00% |
| Dye | 0.21% |
| Water | 0.00% |
| Total Weight of Liquid Concentrate | 100% |

In Example 7, a final diluted product 202 is prepared by mixing the liquid concentrate 201 with water in a weight ratio concentrate:water of about 1:1. In Example 7, approximately 1 pound of the liquid concentrate 201 is mixed with 1 pound of water to prepare the Example 7 final diluted product 202. Alternatively, the final diluted product 202 can be prepared by mixing the liquid concentrate 201 with water in a volume ratio concentrate:water of about 1.0:0.25 to about 1.0:3.0.

In Example 7, the amounts of the ingredients in the final diluted product 202 are listed in Table 36 below. The values in Table 36 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 36

Final Diluted Product according to Example 7

| Ingredient | Weight Percent of Each Ingredient in Final Diluted Product |
|---|---|
| 30% Corrosion Inhibited $MgCl_2$ Solution | 49.50% |
| Thickening agent | 0.10% |
| Pigment | 0.10% |

TABLE 36-continued

| Final Diluted Product according to Example 7 | |
|---|---|
| Ingredient | Weight Percent of Each Ingredient in Final Diluted Product |
| Magnesium Hydroxide | 0.10% |
| Adjuvants | 0.10% |
| Corrosion inhibitor | 0.00% |
| Dye | 0.11% |
| Water | 50.00% |
| Total Weight of Final Diluted Product | 100% |

In the final diluted product 202 of Example 7, the weight percent of magnesium chloride is about 4% to about 30%, preferably about 6% to about 25%, more preferably about 8% to about 20%. For example, the weight percent of magnesium chloride in final diluted product 202 is about 12% to about 18%, and specifically about 15%±1.0%.

The weight percent of adjuvants, relative to the amount of the retardant compound in the final diluted product 202 of Example 7, is about 0.005% to about 2%, preferably about 0.0075% to about 1.75%, more preferably about 0.01% to about 1.5%, and more specifically about 0.025% to about 1.25%. For example, the weight percent of adjuvants, relative to the amount of the retardant compound in the final diluted product 202 of Example 7, is about 0.05% to about 1.0%, and specifically about 0.67%±0.1%.

The fugitive dye will impart a visible tint to the forest fire retardant of Example 7 that will disappear with exposure to sunlight. The forest fire retardant composition of Example 7 is thickened with a thickening agent to increase spraying effectiveness, adhesion to fuel, and an increased surface tension over water. The viscosity of the final diluted product 202 of Example 7 may be in the range of 20-200 cPs, for example 50-100 cPs.

Methods of Use

The forest fire retardant compositions of Examples 1 and 3 may be used to suppress, retard, or contain a forest fire. The forest fire retardant compositions of Examples 1 and 3 function as superior forest fire retardants and suppressants compared to the PHOS-CHEK® brand long-term fire retardants (LTR) which have previously been qualified for use by the USFS. A list of the PHOS-CHEK® USFS Qualified long-term fire retardants is given in Table 37.

TABLE 37

| List of PHOS-CHEK ® USFS Qualified LTR Products | |
|---|---|
| USFS Qualified LTR Products List | Description |
| PHOS-CHEK ® MVP-Fx | Dry Concentrate, Gum-Thickened, High and Medium Viscosity, High Visibility, Fugitive Color |
| PHOS-CHEK ® MVP-F | Dry Concentrate, Gum-Thickened, High and Medium Viscosity, Standard Fugitive Color |
| PHOS-CHEK ® P100-F | Dry Concentrate, Gum-Thickened, High and Medium Viscosity |
| PHOS-CHEK ® 259-Fx | Dry Concentrate, Gum-thickened, Low Viscosity, High Visibility, Fixed Tank Helicopter Powder Concentrate |
| PHOS-CHEK ® 259-F | Dry Concentrate, Gum-thickened, Low Viscosity |
| PHOS-CHEK ® LC-95A-R | Wet Concentrate, Gum-Thickened, Low Viscosity |
| PHOS-CHEK ® LC-95A-Fx | Wet Concentrate, Gum-Thickened, Low Viscosity, High Visibility, Fugitive Color |

TABLE 37-continued

| List of PHOS-CHEK ® USFS Qualified LTR Products | |
|---|---|
| USFS Qualified LTR Products List | Description |
| PHOS-CHEK ® LC-95A-F | Wet Concentrate, Gum-Thickened, Low Viscosity |
| PHOS-CHEK ® LC-95-W | Wet Concentrate, Gum-Thickened, Low Viscosity, Red Iron Oxide, medium Viscosity Liquid Concentrate |

The forest fire retardant compositions of Examples 1 and 3 pull energy out of forest fires at they convert the hydrates of the hydrated salt to free water. When the dry concentrate 101 is mixed with water or when the salt is hydrated in the liquid concentrate 201, the salt becomes hydrated. Because the salt contains magnesium, the most common hydrate is a hexahydrate. For example, when the final diluted composition 103 or 202 includes magnesium chloride hexahydrate, the final diluted composition 103 or 202 contains approximately 10% $MgCl_2$ concentration by weight. The weight of the final diluted composition 103 or 202 increases along with its efficiency. When the product of Examples 1 and/or 3 is wet it functions as a fire suppressant. Once the final diluted composition 103 or 202 has dried after application, the magnesium chloride hexahydrate of the composition effectively retards continued combustion. Magnesium hydroxide interferes with the burning process through the release of inter gases (such as water vapor). In this process a protective char layer is formed or the amount of energy available for the spread of fire is reduced through energy absorption. Magnesium chloride hexahydrate is deliquescent, absorbing sufficient moisture from the air to form an aqueous solution. The critical relative humidity of magnesium chloride hexahydrate is 32%, independent of temperature. The critical relative humidity in both Examples 1 and 3 is approximately 33%. Examples 1 and 3 are also self-rehydrating. The larger the difference between the relative humidity of the atmosphere and the critical relative humidity, the faster the water is rehydrated. Generally, the relative humidity on a wildland fire is lowest during the day and recovers during the night. In moderate burning condition, the nighttime relative humidity recovery will rise to 50%-70%. This is an environmental condition that exists almost every night on wildfires, thereby allowing magnesium chloride hexahydrate to absorb moisture from the air and pull it in to the fuel bed leading to its improved forest fire retardant capabilities. The forest fire retardants of Examples 1 and 3 will start to recover water at a lower relative humidity and recover for a longer time every burning period. Calcium chloride has a similar retarding efficiency to magnesium chloride. Further, calcium chloride saturates in solution at about 40% salt concentration resulting in a higher salt concentration in solution, whereas magnesium chloride saturates at 33% salt concentration. Thus, calcium chloride has potential use as a long-term liquid fire retardant alone or in combination with magnesium chloride. Aluminum hydroxide functions in a similar mechanism to magnesium hydroxide and has potential use as a long-term fire retardant alone or in combination with magnesium hydroxide.

By contrast, the PHOS-CHEK® LTR products of Table 37 need to dry and require heat to produce a carbon coating that buffers the flammable vegetation from the fire's heat and slows the fire spread. Diammonium phosphate (DAP), an ingredient in PHOS-CHEK® LTR products, is semi-hygroscopic and does not absorb sufficient moisture from the air to form an aqueous solution. The critical relative humidity of DAP, a component in PHOS-CHEK® LTR products is 82%, an environmental situation that almost never occurs on a wildland fire, rendering its ability to pull moisture from the air meaningless. DAP is a man-made chemical produced in a factory.

The magnesium chloride hexahydrate in the compositions of Examples 1 and 3 contains six water molecules. Under heat, the six water molecules thermally dehydrate in pairs at progressively higher temperatures: 6 at 243° F., 4 at 358° F. and 2 at 572° F. The first water molecules are released at 243° F., which is above the temperature produced by solar heating, and below the ignition temperature of forest fuels. By contrast, the fire retardant ingredients in PHOS-CHEK® LTR products of Table 37 contain no water molecules. When cellulose fuels are burned in the presence of PHOS-CHEK® LTR products, hydrogen and oxygen both from the cellulose combine to form water. This requires that the fuel must already be burning for this water to form, thereby limiting the effectiveness of PHOS-CHEK® LTR products as a forest fire retardant. This progressive release of water molecules consumes heat, resulting in an endothermic compound that absorbs heat from the flame front. At over 1317° F., the $MgCl_2$ compound dissociates into magnesium and chloride ions.

The forest fire retardant compositions of Examples 1 and 3 rely on a vapor phase radical quenching process. The vapor phase inhibition aims to interrupt the radical gas phase of a fire. By disrupting the phase in which flammable gas is released the system is cooled and the supply of flammable gas is reduced or suppressed. Under heat attack from a wildland fire, but just below the temperature that forest fuels begin to actively burn (523° F.), the magnesium chloride compound in the compositions of Examples 1 and 3 dissociate, and the chloride ion separates from the magnesium to produce $Mg^{++}+2Cl^{-}$. The chloride atoms are released into the gas phase before the material reaches its ignition temperature. The chloride ion is very aggressive and will displace other, less aggressive ions normally active in the rapid chain reaction that occurs just prior to active fire. The chloride ions quench the chemical reaction occurring within the flame and either extinguish the fire or slow the spread of the fire such that there is increased escape time or increased time to attempt other means of fire extinction. The chain reaction interference results in a diverted outcome of the combustion chain reaction and preventing the start of a fire. The chloride ion and six additional water molecules are present in the combustion atmosphere and are effective in retarding fire in the general fire area, not just on the coated fuels. In the PHOS-CHEK® LTR products, by contrast, the fire retardation occurs when the LTR produces a protective and insulating layer of carbon. The vegetation to be protected must be coated. Thus, effectiveness of PHOS-CHEK® LTR products is limited only to the fuels that are coated with the product.

The forest fire retardant compositions of Examples 2 and 4 pull energy out of forest fires as they release inter gases (such as water vapor). In a forest fire, the magnesium hydroxide in the forest fire retardant compositions of Examples 2 and 4 undergo endothermic decomposition, which lessens thermal decomposition of the forest's combustible biomass that acts as fuel. The product of endothermic decomposition of magnesium hydroxide is water vapor and magnesium oxide. The water vapor dilutes the concentration of flammable gases, such as oxygen. In this process a protective char layer is formed and the amount of energy available for the spread of fire is reduced.

Direct Attack

In a direct attack, the final diluted composition 103 and/or 202 is applied on the fire line. The final diluted composition 103 and/or 202 is a thickened water suppressant which contains water to cool and suppress the fire. For example, when the final diluted composition 103 and/or 202 includes magnesium chloride hexahydrate, the water molecules of the magnesium chloride hexahydrate thermally dehydrate at 243° F., 358° F., and 572° F. in an endothermic reaction, absorbing heat from the fire as the reaction progresses and lowering the temperature of the flame front. At over 1317° F., the $MgCl_2$ compound dissociates into magnesium and chloride ions. The chloride ions work to displace the rapid oxidation reactions that occur during the fire. Fire is a rapid oxidation chain reaction. Chloride is an aggressive ion that will flood the combustion chain reaction process of the fire to slow the fire line.

Indirect Attack

In an indirect attack, the final diluted composition 103 and/or 202 is applied in fire containment lines at a significant distance from the fire line. The indirect fire lines are built, and the fire is allowed to burn into them. The long-term fire retardant must be effective even after the water in the composition has evaporated. The final diluted composition 103 and/or 202 is hygroscopic and self-rehydrating. In an indirect attack, the final diluted composition 103 and/or 202 is applied to vegetation. As the water in the final diluted composition 103 and/or 202 evaporates, the salt concentration increases until it reaches its saturation level. For example, when the final diluted composition 103 and/or 202 includes magnesium chloride hexahydrate, the saturation level is about 30% to 35% salt concentration, preferably about 31% to 34% salt concentration, and more preferably about 33% salt concentration. At the saturation level, hydrated $MgCl_2$—$(H_2O)_6$ forms which can act as a long-term fire retardant when exposed to the heat of the fire. When the flame front reaches vegetation treated with the final diluted composition 103, the hydrated water molecules cleave-off in pairs at 243° F., 358° F. and 572° F. in an endothermic reaction, absorbing heat from the fire as the reaction progresses and lowering the temperature of the flame front. The chloride ions will dissociate at 1317° F. and slow the combustion chain reaction process of the fire.

The forest fire retardant compositions of Examples 5, 6, and 7 may be used as ground applied forest fire retardants for indirect attack. The forest fire retardant compositions of Examples 5, 6, and 7 may be suitable for application with spray equipment. The forest fire retardant compositions of Examples 5, 6, and 7 may be resistant to washing off in light rainfall and may also be conditioned for enhanced penetration in dead fuel Field Handling and Measurement The forest fire retardant composition of Example 1 can be delivered to the field either as the dry concentrate 101, liquid concentrate 102 and/or 201, or as the final diluted composition 103 and/or 202. The final diluted composition 103 and/or 202 can be tested prior to application in the field to confirm proper salt content. For example, when the final diluted composition 103 and/or 202 includes magnesium chloride hexahydrate, the magnesium chloride yields between 8.0% and 12% salt by weight, and preferably about 10.0% salt by weight in the final diluted composition 103 and/or 202. A refractometer can be used to test the salt content. Preferably the refractometer reading is about 1.1 to about 1.5, more preferably the refractometer reading is about 1.2 to about 1.4. For example, the refractometer reading is about 1.35 to about 1.37. Density can also be used to determine the salt content. Preferably the density is about 0.8 g/mL to 1.4 g/mL, more preferably the density is about 0.9 g/mL to about 1.2 g/mL. For example, the density is about 1.0 g/mL to about 1.1 g/mL.

Field Mixing Procedures and Ratios

Batch preparation of final diluted composition 202 may be accomplished by slowly feeding the liquid concentrate into a well-stirred mix tank containing a predetermined amount of water. Mix tank agitation may be provided via an overhead mechanical stirring apparatus or alternatively by a circulation pump sized to provide turbulent mixing. Stir until the concentrate is uniformly mixed into the water. Alternatively, the final diluted composition 202 may be mixed using continuous mixing equipment.

For example, a 1500-gallon tank can be charged with 1000 gallons (8345 pounds) of water. The tank is agitated to provide efficient mixing, then 1998.074 kg (4405 pounds) of the liquid concentrate 201 are added. The addition rate is limited by the efficiency of the mixing system. In bulk mixing the addition rate should be limited to prevent concentrate pooling in the bottom of the mix tank. The resulting mixture will provide 5783.3 kg (12,750 pounds) and approximately 1400 gallons of the final diluted composition 202.

Aerial Application

The final diluted composition 103 and/or 202 may be deposited via aerial application from an airplane or helicopter. The airplane may be a fixed-wing multi-engine aircraft, a fixed-wing single engine airtanker (SEAT), a large airtanker (LAT), a very large airtanker (VLAT), or an unmanned aircraft system (UAS). The helicopter may be a fixed-tank helicopter (HF) or it may be a helicopter bucket (HB). The final diluted composition 103 and/or 202 may be deposited in an indirect attack to build a retardant line before a forest fire or directly to a forest fire via aerial application. In particular, a final diluted composition 103 and/or 202 containing calcium chloride may be used in fixed-tank helicopters, given calcium chloride's higher saturation percentage.

Ground Application

The final diluted composition 103 and/or 202 may be deposited via ground application from a truck or ground engine (G). The final diluted composition 103 and/or 202 may be deposited in an indirect attack to build a retardant line before a forest fire or it may be deposited directly to a forest fire via ground application.

Clean Up Procedure

The dry concentrate 101 can be cleaned by broom and/or vacuum. The dry concentrate 101 should be kept dry during cleaning to minimize color staining that may occur when the dye is hydrated. When the dry concentrate 101 is exposed to water, the product can be cleaned with the use of a granular chemical absorbent material, or if proper drainage is available, by rinsing surfaces clean with adequate amounts of water. Dye coloration may be removed from surfaces by treatment with liquid or dry detergent. The final diluted composition 103 can be cleaned with soap or liquid detergent and water. The color of the dye can be neutralized by sodium hypochlorite or washed with liquid detergent.

The liquid concentrate 201 can be cleaned by flushing with water and capturing the rinse in a tank or disposal container via drains. The liquid concentrate 201 and the final diluted composition 202 can be cleaned with soap or liquid detergent and water. The color of the dye can be neutralized by a bleaching agent such as sodium hypochlorite or washed with liquid detergent.

Corrosion Testing

The properties and corrosion inhibition of iron, brass, and aluminum were investigated in a mixture of magnesium chloride (5.6%), Cellosize HEC 4400H Europe (0.58%), triethanolamine (~0.25%) and Wintrol B 40 Na (~150 ppm) in deionized water. This gave a formulation with a viscosity of about 120 cP and was formulated in about 20 minutes. Iron, brass, and aluminum all showed minimal corrosion and the results are shown in Table 38.

TABLE 38

Corrosion of metals in 5.6% MgCl2 and Cellosize HEC 4400H Europe (0.58%)

| Metal | TEA (%) | Wintrol B 40Na (ppm) | Corrosion (mls/year) |
|---|---|---|---|
| Iron | 0.25 | 150 | 0.04 |
| Iron | 0.125 | 150 | 0.03 |
| Iron | 0.063 | 150 | 0.06 |
| Iron (half immersed) | 0.25 | 150 | 1.70 |
| Iron 125° F. | 0.25 | 150 | 0.50 |
| Brass (half immersed) | 0.25 | 150 | 0.00 |
| Brass 125° F. | 0.25 | 150 | 0.13 |
| Aluminum (half immersed) | 0.25 | 150 | 0.01 |
| Aluminum 125° F. | 0.25 | 150 | 0.00 |

Figure 3A:
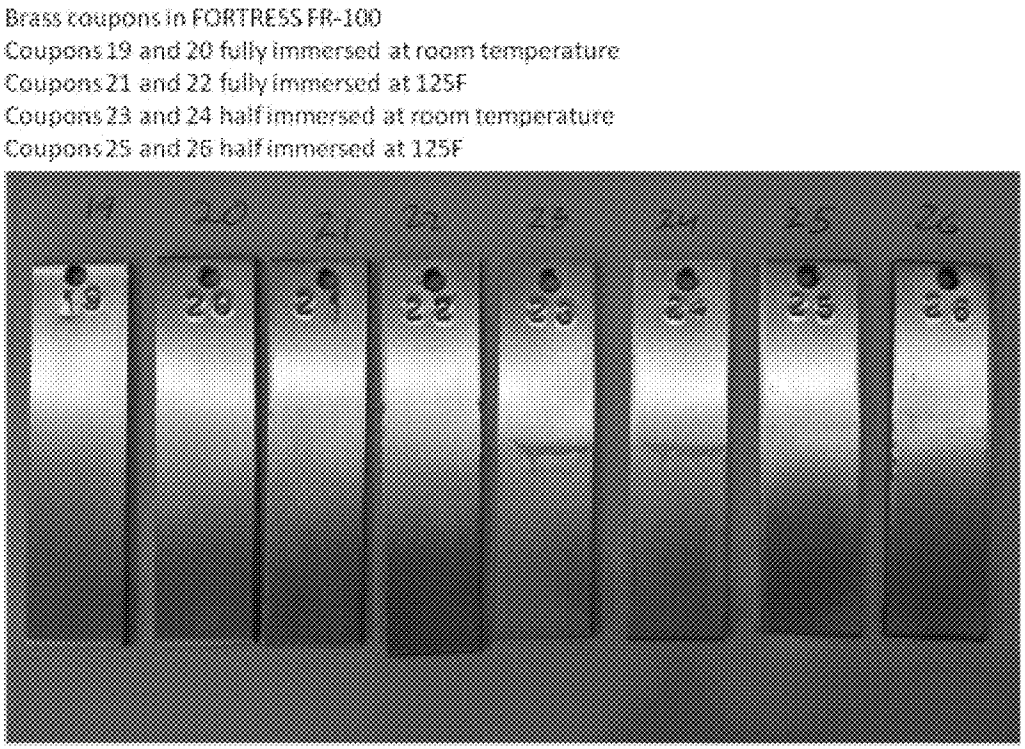
FIG. 3A shows a photograph of general and uniform corrosion of brass coupons under USFS Standard Test procedure with Example 1.
Figure 3B:
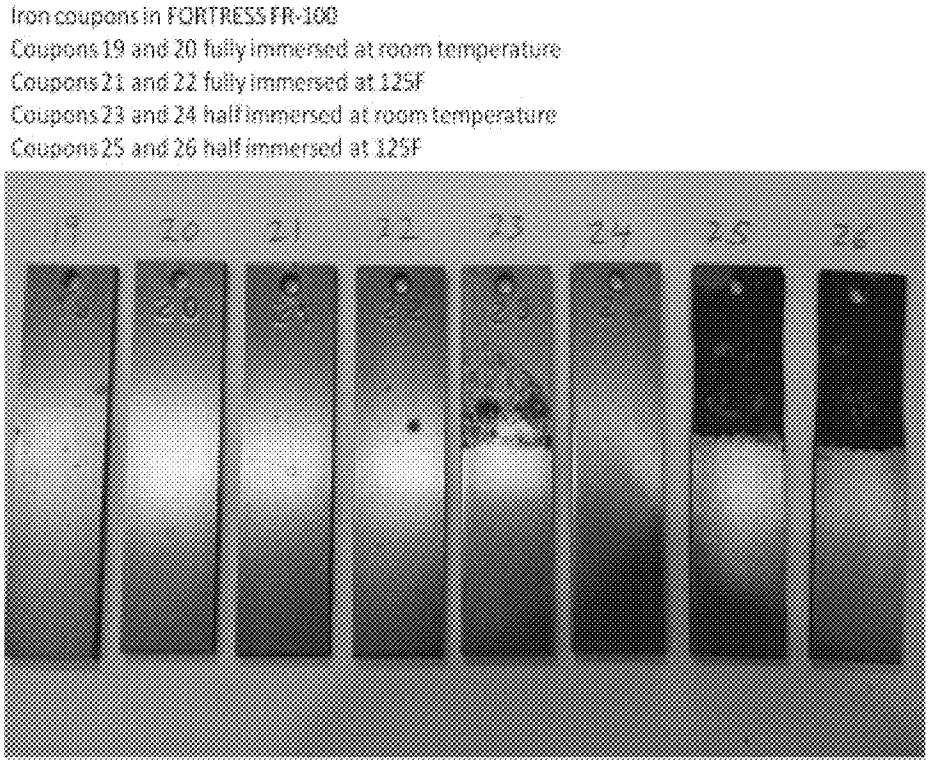
FIG. 3B shows a photograph of general and uniform corrosion of iron coupons under USFS Standard Test procedure with Example 1.
Figure 3C:
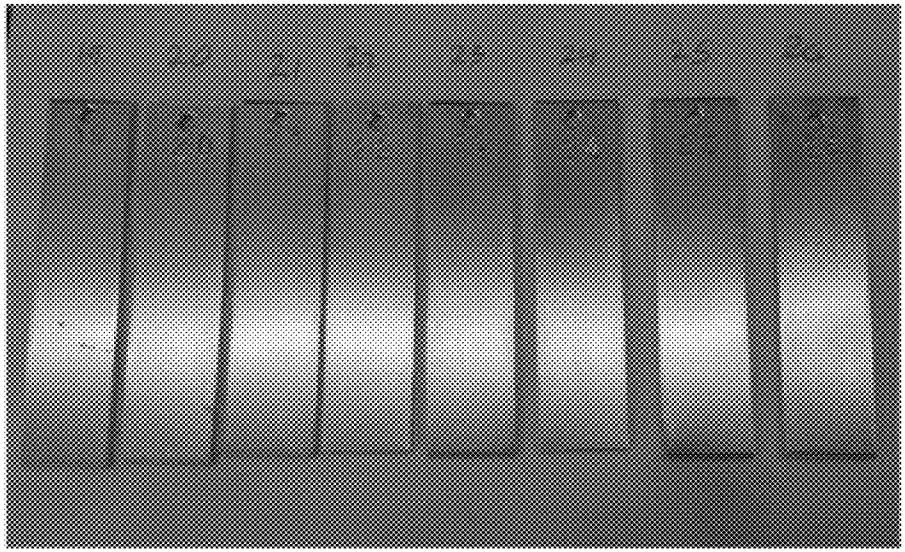
FIG. 3C shows a photograph of general and uniform corrosion of aluminum coupons under USFS Standard Test procedure with Example 1.

FIGS. 3A-3C show the general and uniform corrosion of brass, iron and aluminum under USFS Standard Test procedure with the forest fire retardant composition of Example 1. The commercially available magnesium coupons 1×4 inch were cut into 1×1 inch sections with a hammer and chisel. The iron, brass, and aluminum coupons were secured in a vice and cut using a reciprocating saw. The coupons were prepped according to the USFS Standard Test procedure, by sanding the flat surfaces on fine sandpaper, washing with deionized water, rubbing dry with a paper towel and drying on a hot plate covered with a paper towel. The coupons were cooled and weighed before using. Corrosion tests are performed using a metal test specimen with the dimensions of approximately 1 in×4 in×⅛ in (2.5 cm×10.2 cm×0.3 cm), made of 2024-T3 aluminum, iron, mild steel, yellow brass, or Az31B magnesium for use in uniform corrosion testing. The coupons were either fully immersed or half-immersed in full strength retardant concentration of Example 1 for 90 days. The samples are prepared and placed in test jars according to the preferred product formulation under the USFS Standard Test procedure. The tests were performed in 50 ml plastic tubes having a screw lid. The tubes were filled to 40 milliliters with the test solution and the magnesium coupons were inserted into the tubes and capped lightly to allow any gas formation to escape. The tests were conducted at room temperature and at 125° F. At the conclusion of the experiment the magnesium coupons were washed with water and scraped with a spatula to remove the corrosion products. The coupons were then scrubbed with a medium Scotch-Brite pad, washed with water and deionized water and dried on a hot plate (setting 3-4) covered with a paper towel. The iron coupons were washed with water, scraped with a spatula to remove excess corrosion products, washed with water again and dried on a hot plate (setting 3-4). The coupons were then cooled and bathed for 5 minutes in a solution of SnCl2-2H2O (50 g/L) and SbCl3 (20 g/L) in concentrated hydrochloric acid. The coupons were washed with water, scrubbed with a fine Scotch-Brite pad, washed with tap water, then deionized water and dried on a hot plate (setting 3-4) covered with a paper towel. The coupons were allowed to cool then weighed to determine weight loss. As shown in FIGS.

Figure 3D:
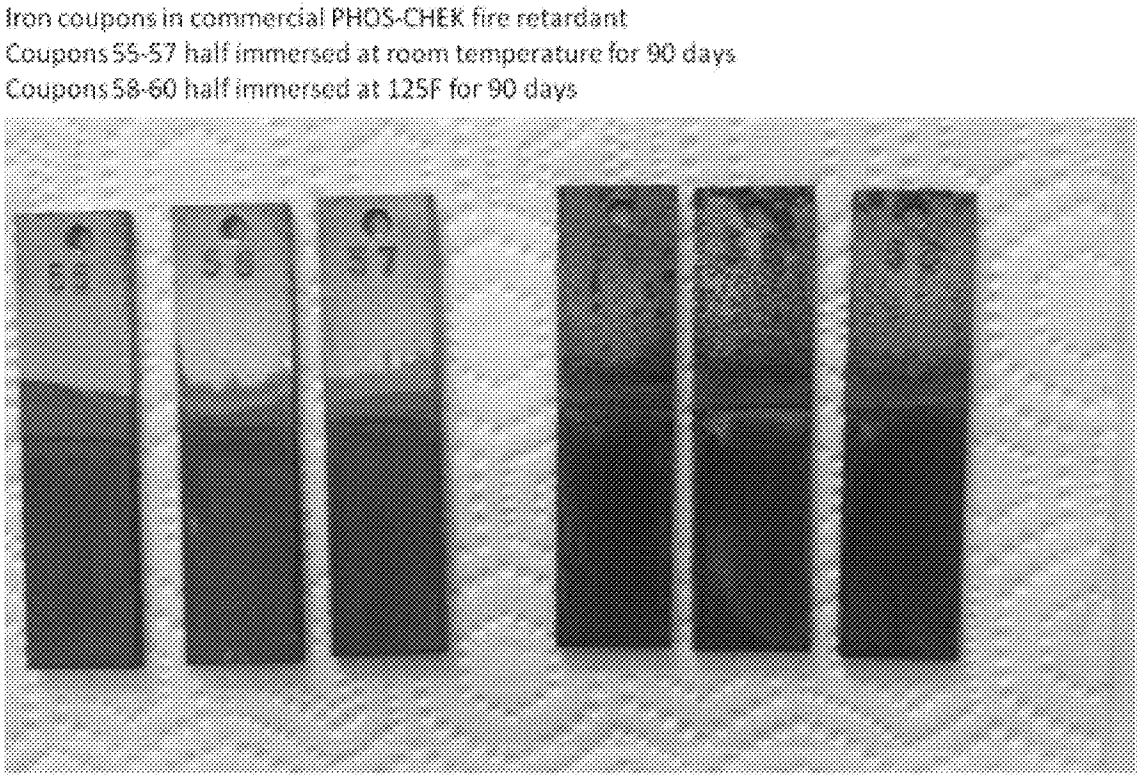
FIG. 3D shows a photograph of general and uniform corrosion of iron coupons under USFS Standard Test procedure with PHOS-CHEK® fire retardant.

3A-3C, the brass, iron, and aluminum coupons all showed corrosion rates of less than 5 mL/year, which is within the USFS approval threshold for general metallic corrosion rates. FIG. 3D shows the general and uniform corrosion of iron coupons under USFS Standard Test procedure with the comparative PHOS-CHEK® fire retardant.

Figure 3E:
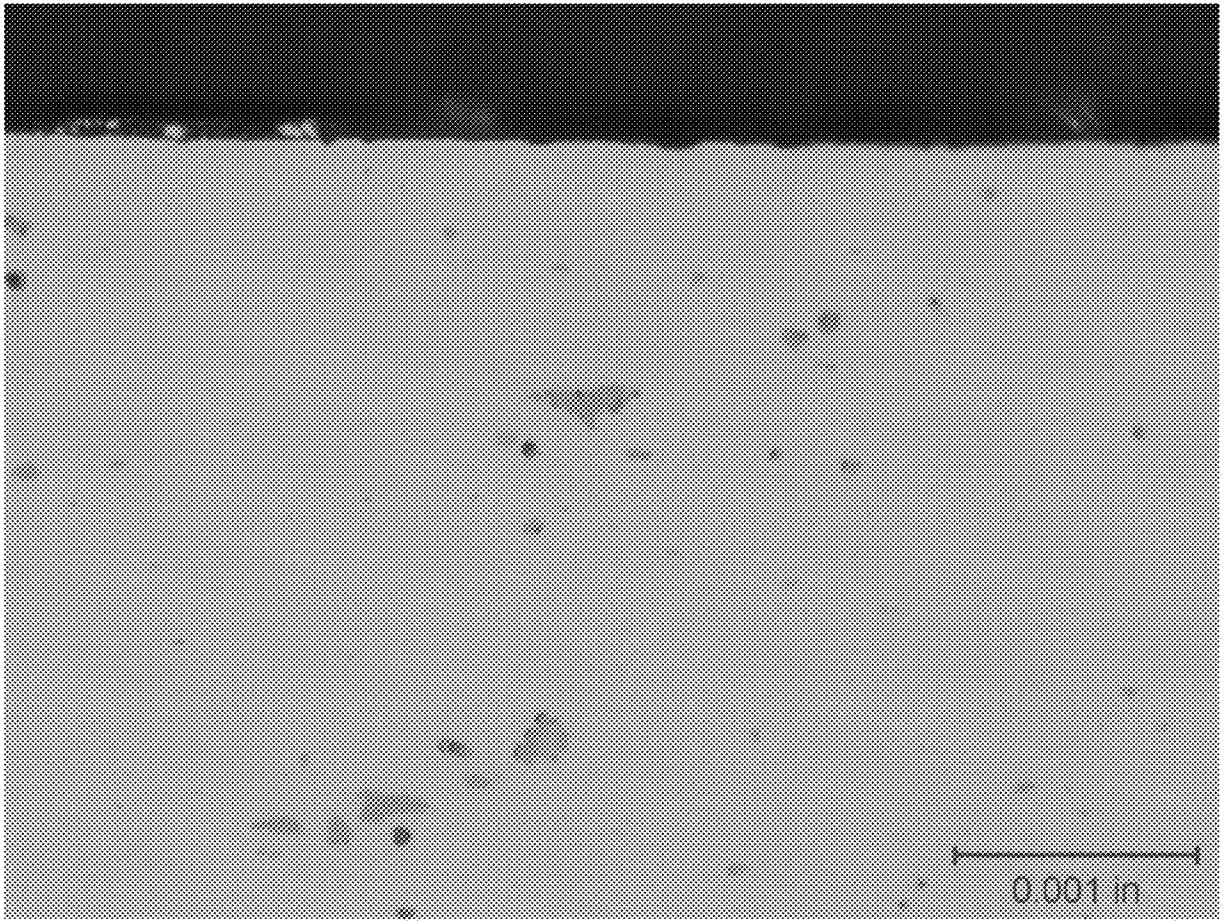
FIG. 3E shows a photograph of intergranular corrosion under USFS Standard Test procedure with Example 1.

FIG. 3E shows the results of the intergranular corrosion of the forest fire retardant composition of Example 1. Example 1 was also tested for intergranular corrosion using optical microscopy by the NSL Metallurgical Analytical Services Inc. Metallurgical preparations of Example 1 were made in accordance with the Active Standard entitled "Standard Guide for Preparation of Metallographic Specimens" (ASTM E 3), hereby incorporated by reference in its entirety. The samples were cut with a water-cooled abrasive blade, rinsed with ethanol and acetone, pressure mounted with thermosetting epoxy resin, ground with silicon carbide abrasives, polished with diamond suspensions, and fine polished with colloidal silica. The microstructure of the samples was not altered during the metallurgic preparations. The evaluation was performed using optical microscopes and imaging system, per the Active Standard entitled "Standard Guide for Reflected-Light Photomicrography (ASTM E 883), hereby incorporated by reference in its entirety. As seen in FIG. 3E, no intergranular corrosion is observed in the samples exposed to the forest fire retardant composition of Example 1.

Toxicity Testing

The forest fire retardant composition of Example 1 was also tested for toxicity. Toxicity data shows a significant improvement of the final diluted composition 103 of Example 1 over various PHOS-CHEK® long-term retardant products. Example 1 contains no biologically active ingredients and is not a fertilizer, so it does not contribute to eutrophication of waters. The chemicals contained in Example 1 are non-carcinogenic and non-hazardous.

Rainbow Trout (*Oncorhynchus mykiss*), 53 days-post-hatch were exposed to the forest fire retardant composition of Example 1 for 96 (±2) hours following the procedures outlined in USDA Forest Service Standard Test Procedure STP-1.5—Fish Toxicity (available at http://www.fs.fed.us/rm/fire/wfcs/tests/stp01_5.htm) and the U.S. Environmental Protection Agency, Office of Prevention, Pesticides, and Toxic Substances. Fish Acute Toxicity Test, Freshwater and Marine; 850.1075, both incorporated herein by reference in its entirety. The fish were maintained in aerated aquaria containing EPA synthetic soft water at 12° C. for nine days prior to their use in this test. The $LC_{50}$ Acute Fish Toxicity Test rates the acute chemical toxicity to fish wherein the numeric value indicates the lethal concentration point at which the chemical results in 50% mortality of fingerling Rainbow Trout. The fish were exposed to 160, 800, 4,000, 10,000, 20,000, and 100,000 mg/L dilutions in 9.5 L of test solution in a 10-L HDPE container of Example 1 for 96 (±2) hours, under static conditions at 12° C. to determine the $LC_{50}$. Each treatment was performed in replica. The $LC_{50}$ values for the PHOS-CHEK® LTR products were derived from the US Forest Service's WFCS Fish Toxicity Test Results; Revised 2017-0906, incorporated herein by reference in its entirety. The $LC_{50}$ values for the final diluted composition 103 of Example 1 were derived from Pacific EcoRisk's laboratory test replicating the USFS 96-hour acute aquatic toxicity test (STP-1.5) on the final diluted composition. The $LC_{50}$ value for the dry concentrate 101 of Example 1 was derived from the USFS 96-hour acute aquatic toxicity test (STP-1.5). The results are shown below in Table 39.

TABLE 39

$LC_{50}$ Acute Fish Toxicity Test

| Long Term Retardant Test Products | LTR Specific Product Number | $LC_{50}$ Test Results (mg/L) |
|---|---|---|
| Final diluted composition 103 of Example 1 | FR-100 | 37,600* |
| Dry concentrate 101 of Example 1 | FR-100 | 1,762 |
| PHOS-CHEK ® | MVP-Fx | 2,024 |
| PHOS-CHEK ® | MVP-F | 2,454 |
| PHOS-CHEK ® | 259-Fx | 860 |
| PHOS-CHEK ® | LC95A-R | 386 |
| PHOS-CHEK ® | LC95A-Fx | 399 |
| PHOS-CHEK ® | LC95A-F | 225 |
| PHOS-CHEK ® | LC95W | 465 |

*95% CI [31,300-45,200 mg/L].

Example 1 was also found to have no biocide effects for *Aspergillus niger, Candida* albicans, Enterobocter oerogenes, *Escherichia coli, Pseudomonas* neruginosn, or *Staphylococcus* nurcus.

Combustion Retarding Effectiveness Testing

Figure 4A:
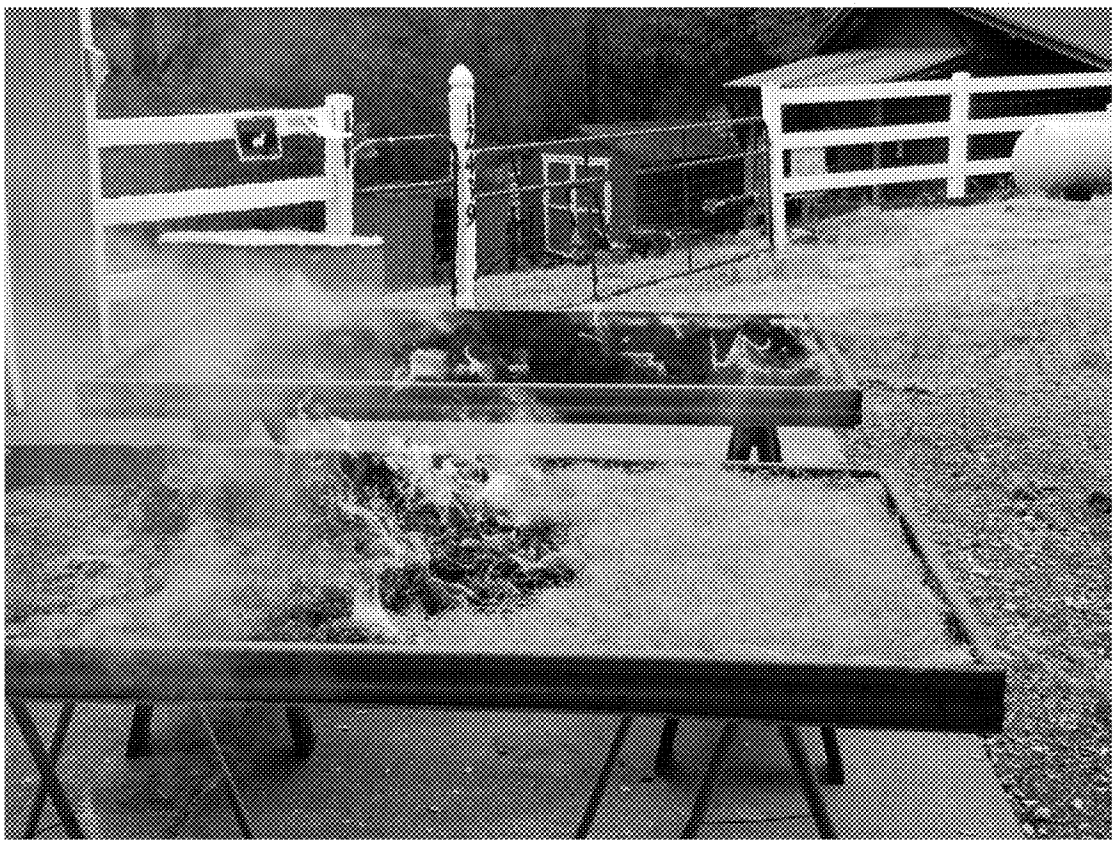
FIGS. 4A-4B show photographs of Example 1 (front) vs. PHOS-CHEK® (Aspen Excelsior, back) in a burn table test.
Figure 4B:
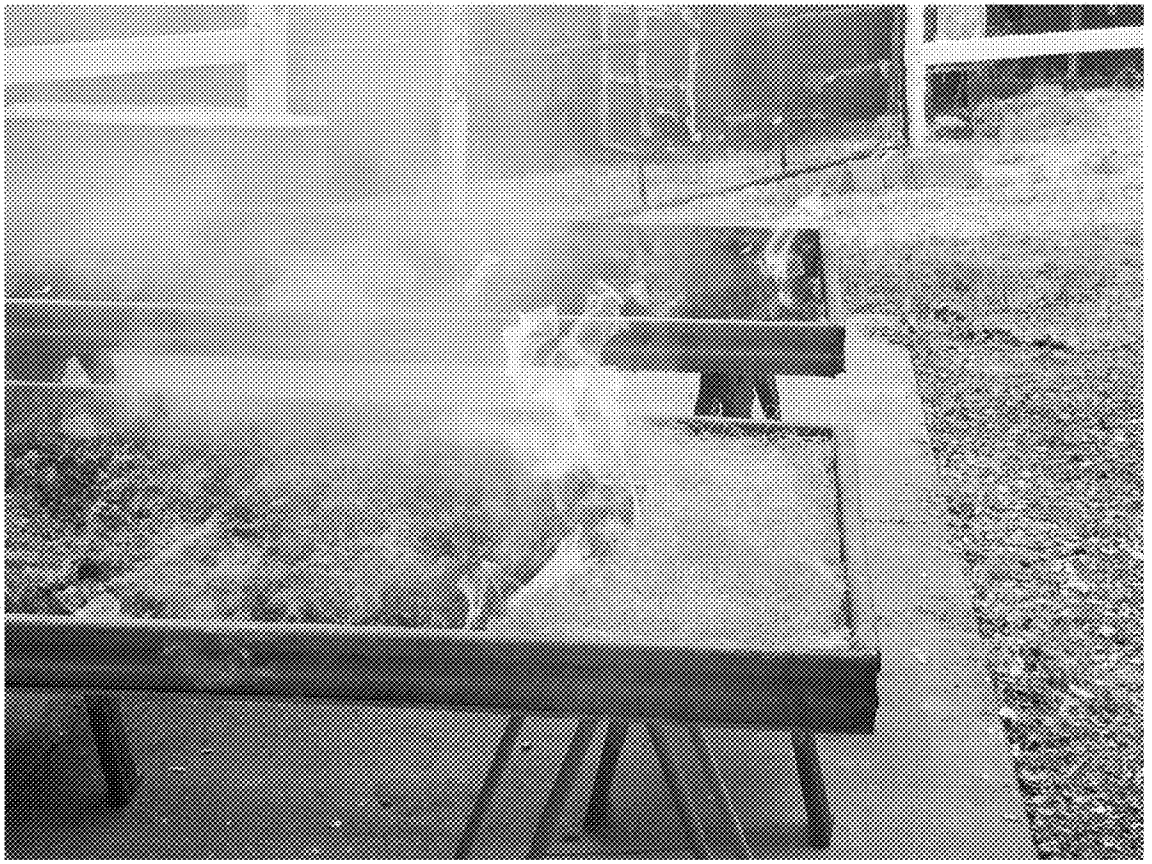
Figure 4C:
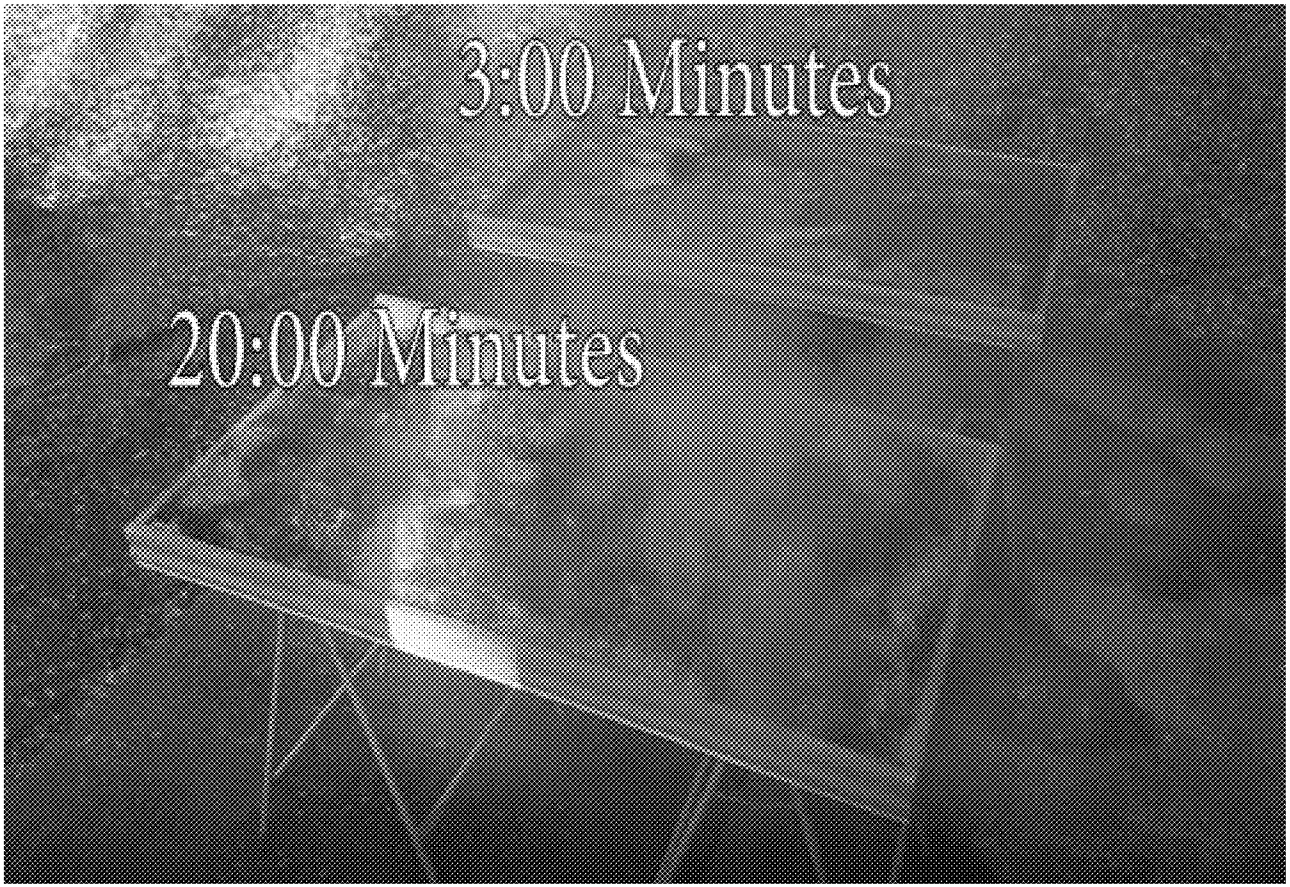
FIG. 4C shows a photograph Example 1 (coverage level 4) at 20:00 minutes (front) vs. untreated at 3:00 minutes (back) in a burn table test.

The forest fire retardant composition of Example 1 was further tested in a combustion retarding effectiveness test according to the USDA Forest Service Standard Test Procedure. Example 1 underwent burn table testing at both 1 and 2 gallons per hundred square feet (GPC) forest fire retardant coverage levels over Ponderosa pine needles and Aspen excelsior. The results show that in all burn test iterations, Example 1 either replicated the effectiveness of the U.S. Forest Service's control test fire retardant (a technical grade diammonium phosphate (21-53-0 DAP)), or exhibited fire retarding effectiveness that exceeded the control test fire retardant as shown in FIGS. 4A and 4B. Example 1 was also compared to existing PHOS-CHEK® products in a burn test. With Example 1, the burn table was consumed after 20 minutes. However, with PHOS-CHEK® LTR products the burn table was consumed in 15 minutes.

CONCLUSION

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein.

In addition, any combination of two or more such features, systems, articles, materials, kits, and/or methods, if such features, systems, articles, materials, kits, and/or methods are not mutually inconsistent, is included within the inventive scope of the present disclosure. Other substitutions, modifications, changes, and omissions may be made in the design, operating conditions and arrangement of respective elements of the exemplary implementations without departing from the scope of the present disclosure. The use of a numerical range does not preclude equivalents that fall outside the range that fulfill the same function, in the same way, to produce the same result.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

In the claims, as well as in the specification, any ingredient listed in an open-ended list of ingredients shall not be negated or avoided by the addition of water or other solvent or reactant that might cause a chemical change to such ingredient. Thus, for example, even though it is known that an anhydrous salt becomes hydrated in the presence of water, the inventors hereby act as their own lexicographers, so that any composition "including" or "comprising" an "anhydrous" salt is intended to cover both a dry composition substantially free of water in which the salt has substantially no water of hydration, as well as any wet composition formed by the addition of water which causes the anhydrous salt to become hydrated (or to undergo some other change). Both before and after the addition of water or other ingredient, the composition shall be regarded, for purposes of the specification and claims, as comprising an "anhydrous" salt irrespective of any hydration, solvation, or other change caused by the addition of water or other ingredient. The same applies for any ingredient recited in an open-ended list which might be chemically changed by the addition of water or other ingredient to the open-ended list.

The invention claimed is:

1. A forest fire retardant composition, comprising:

a retardant compound comprising a least one of $MgCl_2$ anhydrous and magnesium chloride hydrate $MgCl_2(H_2O)_x$ present in the composition in an amount having a weight ratio ($MgCl_2$ anhydrous:$MgCl_2(H_2O)_x$) of about 0:100 or about 20:80 to about 50:50;

a corrosion inhibitor for at least one of iron, brass, or aluminum, present in the composition in an amount having a weight percent of about 0.25% to about 5.0% relative to the weight of the retardant compound in the composition;

a thickening agent, present in the composition in an amount having a weight percent of about 0.25% to about 3.5% relative to the weight of the retardant compound in the composition;

a buffering agent, present in the composition in an amount having a weight percent of about 0.6% to about 3.0% relative to the weight of the retardant compound in the composition; and a colorant, present in the composition in an amount having a weight percent of about 0.02% to about 3.0% relative to the weight of the retardant compound in the composition.

2. The composition of claim 1, wherein the magnesium chloride hydrate $MgCl_2(H_2O)_x$ comprises magnesium chloride hexahydrate $MgCl_2(H_2O)_6$.

3. The composition of claim 2, wherein the weight ratio ($MgCl_2$ anhydrous:$MgCl_2(H_2O)_6$) is about 30:70 to about 40:60.

4. The composition of claim 1, further comprising a pigment, present in the composition in an amount having a weight percent of about 0.05% to about 1.5% relative to the weight of the retardant compound in the composition.

5. The composition of claim 4, wherein the pigment comprises titanium dioxide.

6. The composition of claim 1, further comprising a mineral oil, present in the composition in an amount having a weight percent of about 0.25% to about 2.5% relative to the weight of the retardant compound in the composition.

7. The composition of claim 1, wherein the colorant comprises a fluorescent pigment.

8. The composition of claim 1, wherein the thickening agent comprises a polysaccharide gum.

9. The composition of claim 8, wherein the polysaccharide gum comprises xanthan gum.

10. The composition of claim 1, wherein the buffering agent comprises triethanolamine.

11. The composition of claim 1, wherein the corrosion inhibitor comprises one or more azoles.

12. The composition of claim 1, wherein:

the composition is a dry concentrate having no more than about 3% by weight of water relative to the total weight of the dry concentrate; and the retardant compound is present in the dry concentrate in an amount having a weight percent of about 75% to about 96% relative to the total weight of the dry concentrate.

13. A kit comprising:

a sealed container which contains the composition of claim 12 substantially in the absence of external moisture; and instructions for using the composition to make a final diluted product useful to suppress, retard, or contain forest fires.

14. The composition of claim 1, further comprising water; wherein:

the composition is a final diluted product intended for use to suppress, retard, or contain forest fires;

the $MgCl_2$ anhydrous is hydrated by the water in the final diluted product; and the retardant compound is present in the final diluted product in an amount having a weight percent of about 7% to about 30% relative to the total weight of the final diluted product.

15. The composition of claim 1, further comprising at least one of a spoilage inhibitor, a flow conditioner, an anti-foaming agent, a foaming agent, a stability additive, a biocide, a second thickening agents a surfactants an adjuvant, a second corrosion inhibitor, an opacifier, a second colorant, or a liquid carrier.

16. The composition of claim 1, wherein the magnesium chloride hydrate $MgCl_2(H_2O)_x$ comprises a mixture of magnesium chloride hydrates $MgCl_2(H_2O)_x$, wherein x is at least one of 1, 2, 4, 6, 8, or 12.

* * * * *